US011280328B2

(12) United States Patent
Kim et al.

(10) Patent No.: US 11,280,328 B2
(45) Date of Patent: Mar. 22, 2022

(54) LINEAR COMPRESSOR

(71) Applicant: LG Electronics Inc., Seoul (KR)

(72) Inventors: Hyunsoo Kim, Seoul (KR); Sangeun Bae, Seoul (KR); Yunhyeok Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 272 days.

(21) Appl. No.: 16/430,559

(22) Filed: Jun. 4, 2019

(65) Prior Publication Data

US 2020/0018302 A1 Jan. 16, 2020

(30) Foreign Application Priority Data

Jul. 13, 2018 (KR) ..... 10-2018-0081911

(51) Int. Cl.
*F04B 39/12* (2006.01)
*F04B 19/04* (2006.01)
(Continued)

(52) U.S. Cl.
CPC ..... *F04B 39/0044* (2013.01); *F04B 19/04* (2013.01); *F04B 35/045* (2013.01); *F04B 39/127* (2013.01); *F04B 53/003* (2013.01)

(58) Field of Classification Search
CPC .. F04B 35/045; F04B 39/0044; F04B 39/127; F04B 39/121; F04B 39/023; F04B 39/14;
(Continued)

(56) References Cited

U.S. PATENT DOCUMENTS 4,137,014 A * 1/1979 Parker ..... F04B 35/04 417/326
6,092,999 A 7/2000 Llie et al.
(Continued)

FOREIGN PATENT DOCUMENTS

CN 101802403 8/2010
CN 105298795 2/2016
(Continued)

OTHER PUBLICATIONS

Extended European Search Report in European Application No. 19155512.7, dated May 28, 2019, 12 pages.
(Continued)

*Primary Examiner* — Dominick L Plakkoottam
(74) *Attorney, Agent, or Firm* — Fish & Richardson P.C.

(57) ABSTRACT

A linear compressor includes a shell having a first opening and a second opening defined at opposite ends of the shell, a compressor body including a cylinder and a piston accommodated in the shell, a support part that protrudes from an end portion of the compressor body toward the second opening, a supporting damper that extends from the support part toward an inner surface of the shell. The supporting damper includes a first portion that is coupled to the support part and that defines a single contact region between the support part and the supporting damper, and at least two second portions that extend from the first portion to the inner surface of the shell and that define at least two contact regions that are spaced apart from each other along the inner surface of the shell.

24 Claims, 15 Drawing Sheets

(51) Int. Cl.
*F04B 39/00* (2006.01)
*F04B 35/04* (2006.01)
*F04B 53/00* (2006.01)

(58) Field of Classification Search
CPC ..... F04B 53/003; F04B 53/22; F04B 39/12; F04B 39/0027; Y10S 417/902
See application file for complete search history.

(56) References Cited

U.S. PATENT DOCUMENTS

| | | | | |
|---|---|---|---|---|
| 6,786,707 | B2 * | 9/2004 | Kim | F04C 18/0215 417/363 |
| 7,278,834 | B2 * | 10/2007 | Herrick | F04B 39/0044 248/638 |
| 7,626,289 | B2 * | 12/2009 | Her | F04B 35/045 310/12.04 |
| 7,722,335 | B2 * | 5/2010 | Kim | F04B 39/127 417/363 |
| 7,887,306 | B2 * | 2/2011 | Lee | F04B 39/127 417/363 |
| 7,921,845 | B2 * | 4/2011 | Kim | F04B 39/0055 128/204.18 |
| 7,922,463 | B2 * | 4/2011 | Lee | F04B 35/045 417/417 |
| 8,109,740 | B2 * | 2/2012 | Kang | F04B 39/121 417/417 |
| 8,678,782 | B2 * | 3/2014 | Williams | F04B 35/045 417/363 |
| 9,845,798 | B2 * | 12/2017 | Miguel | F04B 39/06 |
| 9,890,772 | B2 * | 2/2018 | Noh | F04B 39/1033 |
| 10,753,350 | B2 * | 8/2020 | Ha | F04B 39/123 |
| 10,830,232 | B2 * | 11/2020 | Kim | F04B 39/08 |
| 10,900,477 | B2 * | 1/2021 | Kim | F04B 39/121 |
| 2004/0223859 | A1 * | 11/2004 | Sharp | F04B 39/127 417/363 |
| 2016/0017877 | A1 * | 1/2016 | Ki | F04B 39/127 417/437 |
| 2019/0271301 | A1 * | 9/2019 | Steen | F04B 39/127 |
| 2021/0003122 | A1 * | 1/2021 | Jeon | F04B 39/121 |

FOREIGN PATENT DOCUMENTS

| | | |
|---|---|---|
| CN | 105298799 | 2/2016 |
| CN | 105829714 | 8/2016 |
| CN | 106979137 | 7/2017 |
| DE | 19651624 | 6/1997 |
| EP | 2975267 | 1/2016 |
| EP | 3242026 | 11/2017 |
| JP | S58187589 | 11/1983 |
| KR | 101451953 | 10/2014 |
| KR | 10-2016-0000403 | 1/2016 |
| KR | 1020170124910 | 11/2017 |

OTHER PUBLICATIONS

CN Office Action in Chinese Appln. No. 201910104209.5, dated Feb. 1, 2021, 15 pages (with English translation).

* cited by examiner

LINEAR COMPRESSOR

CROSS-REFERENCE TO RELATED APPLICATIONS

The present application claims priority under 35 U.S.C. 119 and 35 U.S.C. 365 to Korean Patent Application No. 10-2018-0081911, filed on Jul. 13, 2018, which is hereby incorporated by reference in its entirety.

TECHNICAL FIELD

The present disclosure generally relates to a linear compressor.

BACKGROUND

Cooling systems may circulate refrigerant to generate cool air. For example, a cooling system may perform processes of compressing, condensing, expanding, and evaporating of the refrigerant. For those processes, the cooling system may include a compressor, a condenser, an expansion device, and an evaporator. In some cases, the cooling system may be installed in a home appliance such as a refrigerator or air conditioner.

Compressors are machines that can receive power from a power generation device such as an electric motor or a turbine to compress air, a refrigerant, or various working gases to thereby increase a pressure of the air, refrigerant, or various working gases. Compressors may be used in home appliances or industrial fields.

Compressors may be classified into reciprocating compressors, rotary compressors, and scroll compressors. The reciprocating compressors have a compression space into/from which a working gas is suctioned and discharged. The compression space of the reciprocating compressors may be defined between a piston and a cylinder to allow the piston to be linearly reciprocated into the cylinder to thereby compress a refrigerant. The rotary compressors may have a compression space into/from which a working gas is suctioned or discharged. The compression space of the rotary compressors may be defined between a roller that eccentrically rotates and a cylinder to allow the roller to eccentrically rotate along an inner wall of the cylinder to thereby compress a refrigerant. The scroll compressors may have a compression space into/from which is suctioned or discharged. The compression space of the scroll compressors may be defined between an orbiting scroll and a fixed scroll that are to compress a refrigerant while the orbiting scroll rotates along the fixed scroll.

A linear compressor may be directly connected to a driving motor configured to a piston to linearly reciprocate. The linear compressor may have an improved compression efficiency with reduced mechanical losses due to motion conversion, and the linear compressor may have a simple structure.

The linear compressor may suction and compress a refrigerant within a sealed shell while a piston linearly reciprocates within the cylinder by a linear motor, and then may discharge the compressed refrigerant.

In some cases, the linear motor may include a permanent magnet disposed between an inner stator and an outer stator. The permanent magnet may be driven to linearly reciprocate by electromagnetic force between the permanent magnet and the inner (or outer) stator. Since the permanent magnet operates in a state where the permanent magnet is connected to the piston, the permanent magnet may cause the piston to suction and compress the refrigerant while linearly reciprocating within the cylinder and then discharge the compressed refrigerant.

In some examples, the linear compressor may include a compressor body disposed in a shell having a cylindrical shape, and each of front and rear ends of the compressor body may be supported by a plate spring.

In some cases, the linear compressor may further include a plurality of bolts for stably supporting the plate spring, a washer for preventing the bolts from being released, and a rubber for buffering. The above-described components may be disposed at a plurality of positions, and the total number of the components may increase, which may cause a reduction of productivity and an increase of manufacturing cost.

In some cases, the components for supporting the plate spring may be provided in plurality, which may increase a possibility of occurrence of defects during an assembly of the linear compressor. The components for supporting the plate spring may generate vibration and noise.

In some cases, where each of both ends of the compressor body may be supported by the plate spring, a damping effect may be relatively low, which may deteriorate absorption ability for the vibration and noise.

SUMMARY

Implementations provide a linear compressor in which a compressor body is stably supported to mitigate separation during transportation and operation, and to mitigate excess variations in attitude of the compressor.

Implementations also provide a linear compressor in which a supporting damper supporting a compressor body is simplified in configuration to improve productivity and reduce manufacturing cost.

Implementations also provide a linear compressor in which a supporting damper supporting a compressor body is simplified in assembly structure to mitigate occurrences of defects and to improve quality.

Implementations also provide a linear compressor in which a supporting damper supporting a compressor body is improved in damping performance to reduce vibration and noise during an operation of the compressor.

According to one aspect of the subject matter described in this application, a linear compressor includes: a shell that defines an outer appearance of the linear compressor and that extends along a longitudinal direction of the shell, where the shell has a first opening and a second opening that are defined at opposite ends of the shell; a compressor body accommodated in the shell, where the compressor body includes a cylinder and a piston disposed in the cylinder and configured to move in the longitudinal direction to thereby compress refrigerant within the cylinder; a support part that protrudes from an end portion of the compressor body toward the second opening of the shell; and a supporting damper that extends from the support part toward an inner surface of the shell. The supporting damper includes a first portion that is coupled to the support part and that defines a single contact region between the support part and the supporting damper, and at least two second portions that extend from the first portion to the inner surface of the shell and that define at least two contact regions that are spaced apart from each other along the inner surface of the shell.

Implementations according to this aspect may include one or more of the following features. For example, the linear compressor may further include a first shell cover that covers the first opening of the shell, and a second shell cover that covers the second opening of the shell. In some examples, the supporting damper may be configured to attenuate vibration of the compressor body. In some examples, the linear compressor may further include a first supporting damper that connects a first end portion of the compressor body to the first shell cover, where the first supporting damper is configured to attenuate vibration of the compressor body. The supporting damper may be a second supporting damper disposed at a second end portion of the compressor body opposite to the first end portion.

In some implementations, the at least two second portions radially extend outward from a side of the support part toward the inner surface of the shell, are configured to support the side of the support part, and are spaced apart from each other by a set angle. For example, the set angle may be in a range from 90° to 120°. In some implementations, the linear compressor may further include a mounting leg disposed at an outer surface of the shell and configured to fix and mount the shell to a base, where the supporting damper extends from the support part toward a position of the inner surface of the shell corresponding to a position of the outer surface of the shell at which the mounting leg is disposed.

In some implementations, the second shell cover may include: a recess part that is recessed from an outer surface of the second shell cover toward an inside of the shell, that overlaps an upper portion of the support part in the longitudinal direction, and that is configured to restrict an upward movement of the support part; and an accommodation part that is stepped from the recess part, that protrudes outward of the recess part toward the outer surface of the second shell cover, and that accommodates the supporting damper.

In some examples, the accommodation part may include a center accommodation part that extends radially outward from a center of the second shell cover, that faces an outer circumferential surface of the support part, and that accommodates at least a portion of the support part; and an extension accommodation part that extends from a side of the center accommodation part to a circumferential surface of the second shell cover and that accommodates the supporting damper. In some implementations, the support part may include a support part end surface that faces the second shell cover, and a support part groove recessed inward from the support part end surface toward the compression body.

In some implementations, the support part may define a damper mounting part recessed from a circumferential surface of the support part, and the supporting damper may include a coupling protrusion disposed at the first portion of the supporting damper and configured to be inserted into the damper mounting part to thereby fix the supporting damper to the support part. In some examples, the linear compressor may further include a seating member that is made of an elastic material and that is disposed between the damper mounting part and the coupling protrusion, the seating member having a shape corresponding to the coupling protrusion.

In some examples, the damper mounting part may include a first mounting groove recessed from the circumferential surface of the support part to a first position, and a second mounting groove recessed from the first mounting groove to a second position radially inward of the first position. The coupling protrusion may include a first protrusion configured to be inserted into the first mounting groove, and a second protrusion that protrudes from the first protrusion and that is configured to be inserted into the second mounting groove. In some cases, the damper mounting part may be an opening having a polygonal shape, and the damper coupling part has a shape corresponding to the polygonal shape.

In some implementations, the supporting damper is a single body having a V-shape, and the first portion and the at least two second portions of the supporting damper are parts of the single body. In some examples, the at least two second portions may include: supporting legs that are coupled to the support part and that extend to the inner surface of the shell in directions symmetrical to each other with respect to the support part; a contact member disposed at an end of each supporting leg and configured to contact the inner surface of the shell at one of the at least two contact regions; and an elastic member that connects between the end of each supporting leg and an inner end of the contact member that faces the corresponding supporting leg.

In some implementations, the first supporting damper may include an elastic plate having a plate spring shape, a plurality of coupling members disposed at an edge region of the elastic plate and coupled to the compressor body, and a plate fixing member disposed at a center of the elastic plate and supported by the first shell cover.

According to another aspect, a linear compressor includes: a shell; a compression body that is disposed in the shell and that includes a cylinder disposed in the shell, a piston disposed in the cylinder and configured to compress refrigerant in the cylinder, and a motor assembly configured to drive the piston to move relative to the cylinder; a discharge cover that is disposed at a side of the cylinder and that defines a cover space configured to receive refrigerant that is compressed by the piston and discharged from the cylinder; a support part that protrudes from an end portion of the discharge cover; and a supporting damper that connects the support part to an inner surface of the shell and that is configured to attenuate vibration of the compression body. The supporting damper includes: a supporting leg including a first portion coupled to the support part and at least two second portions that extend toward the inner surface of the shell in directions symmetrical to each other with respect to the support part; a contact member disposed at an end of each of the at least two second portions and configured to contact the inner surface of the shell; and an elastic member that connects the end of each of the at least two second portions and an inner end of the contact member that faces the corresponding second portion of the supporting leg.

Implementations according to this aspect may include one or more of the following features or the features described above. For examples, the support part and the discharge cover may be parts of a single body. In some examples, the elastic member may be made of a spring material, and configured to maintain a gap defined between the supporting leg and the contact member.

In some implementations, the linear compressor may further include a mounting leg disposed at an outer surface of the shell and configured to fix and mount the shell to a base, and the supporting damper may be disposed between the mounting leg and the support part. In some examples, the support part has a cylindrical shape, and the first portion of the supporting leg may include a seating part that has a curved shape corresponding to a circumferential surface of the support part and that supports the circumferential surface of the support part.

In some implementations, the linear compressor may further include a side stopper that protrudes from an outer surface of the discharge cover toward the shell and that is configured to limit movement of components within the shell in a direction toward the inner surface of the shell. The side stopper may be disposed at a position between the at least two second portions of the supporting leg. In some cases, the side stopper may be disposed at an extension line that extends from the support part toward a center of the supporting damper.

The details of one or more implementations are set forth in the accompanying drawings and the description below. Other features will be apparent from the description and drawings, and from the claims.

DETAILED DESCRIPTION

Hereinafter, exemplary implementations will be described with reference to the accompanying drawings. The disclosure may, however, be implemented in many different forms and should not be construed as being limited to the implementations set forth herein.

Figure 1:
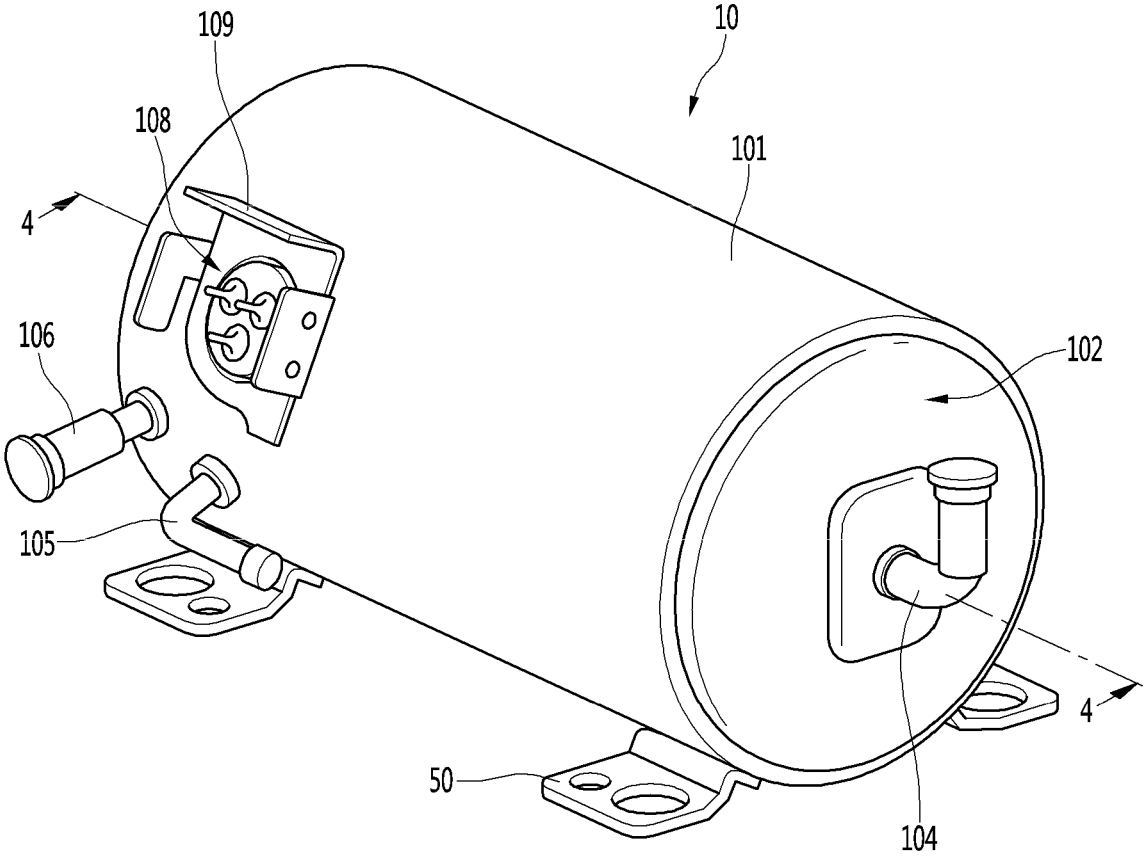
FIG. 1 is a perspective view of an example linear compressor viewed from one side of the linear compressor.
Figure 2:
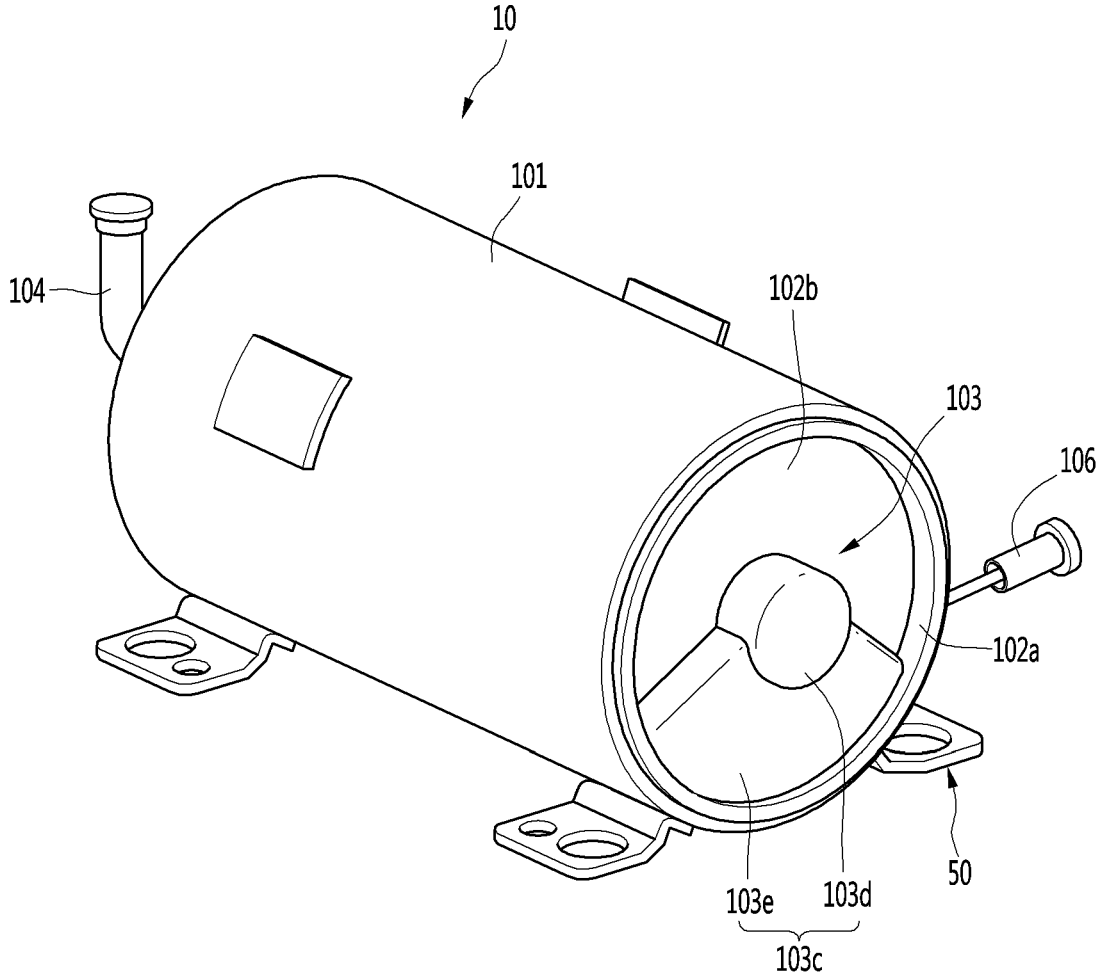
FIG. 2 is a perspective view of the linear compressor viewed from another side of the linear compressor of FIG. 1.

FIG. 1 is a perspective view of an example linear compressor viewed from one side of the linear compressor. FIG. 2 is a perspective view of the linear compressor viewed from another side.

As illustrated in the drawings, a linear compressor 10 may include a shell 101 and shell covers 102 and 103 coupled to the shell 101. In a broad sense, each of the first and second shell covers 102 and 103 may be understood as components of the shell 101.

A mounting leg 50 may be coupled to an outside of the shell 101, for examples, at a lower portion of the shell 101. The mounting leg 50 may be coupled to a base of a product in which the linear compressor 10 is installed. For example, the product may include a refrigerator, and the base may include a machine room base of the refrigerator. As another example, the product may include an outdoor unit of an air conditioner, and the base may include a base of the outdoor unit.

The shell 101 may have an approximately cylindrical shape and be disposed to lie in a horizontal direction, i.e., an axial direction of the cylindrical shape.

Hereinafter, the axial direction may be understood as a direction in which a virtual extension line connecting centers of both opened surfaces of the shell 101 or a motion direction of a piston 130, which is a component of the compressor body. Also, a radial direction may be understood as a direction that is perpendicular to the motion direction of the piston 130. Also, a direction that is directed from the first shell cover 102 toward the second shell cover 103 may be referred to as a front direction, and an opposite direction may be referred to as a rear direction.

In FIG. 1, the shell 101 may extend in the horizontal direction and have a relatively low height in a radial direction. That is, since the linear compressor 10 has a low height, when the linear compressor 10 is installed in the machine room base of the refrigerator, a machine room may be reduced in height.

A terminal 108, to which an external power source is connected, may be installed on an outer surface of the shell 101. Also, a bracket 109 for protecting the terminal 108 may be installed outside the terminal 108.

Both sides of the shell 101 may be opened, and define a first opening at a first side of the shell 101 and a second opening at a second side of the shell 101. The shell covers 102 and 103 may be coupled to the opened sides of the shell 101, respectively. In detail, the shell covers 102 and 103 include a first shell cover 102 coupled to the first opening of the shell 101 and a second shell cover 103 coupled to the second opening of the shell 101. An inner space of the shell 101 may be sealed by the shell covers 102 and 103.

In FIG. 1, the first shell cover 102 may be disposed at a right portion of the linear compressor 10, and the second shell cover 103 may be disposed at a left portion of the linear compressor 10. That is to say, the first and second shell covers 102 and 103 may be disposed to face each other.

The linear compressor 10 may include a suction pipe 104 through which a refrigerant is suctioned into the linear compressor 10, a discharge pipe 105 through which the compressed refrigerant is discharged from the linear compressor 10, and a process pipe through which the refrigerant is supplemented to the linear compressor 10.

For example, the suction pipe 104 may be coupled to the first shell cover 102. Also, the discharge pipe 105 and the process pipe 106 may be coupled to an outer circumferential surface of the shell 101.

The second shell cover 103 may be inserted into an opening of the shell 101 so that a cover edge 103*a* comes into contact with an inner surface of the shell 101. Also, the opened surface of the second shell cover 103 may be coupled (e.g., completely coupled) to be sealed through press-fitting. Also, the second shell cover 103 may be further coupled through an operation such as welding in a state in which the second shell cover 103 is inserted into the opening of the shell 101.

The second shell cover 103 may be constituted by a recess part 103*b* and an accommodation part 103*c*. The recess part 103*b* and the accommodation part 103*c* may define the inside of the cover edge 103*a* and also define one surface of the linear compressor 10. The recess part 103*b* and the accommodation part 103*c* may be stepped at different heights. Thus, the accommodation part 103*c* may further protrude outward from the recess part 103*b* in the axial direction. Here, the accommodation part 103*c* may be disposed further inside than the outer end of the shell 101.

Also, the accommodation part 103*c* may provide a space in which a second supporting damper 300 that will be described below is accommodated. Thus, the accommodation part 103*c* may include a center accommodation part 103*d* disposed at a center of the second shell cover 103 and an extension accommodation part 103*e* extending up to the cover edge 103*a* with respect to the center accommodation part 103*d*. The extension accommodation part 103*e* may have a fan shape that is capable of accommodating the second supporting damper 300. Also, the extension accommodation part 103*e* may be disposed to face a lower side of the linear compressor 10 on which the mounting leg 50 is disposed.

Figure 3:
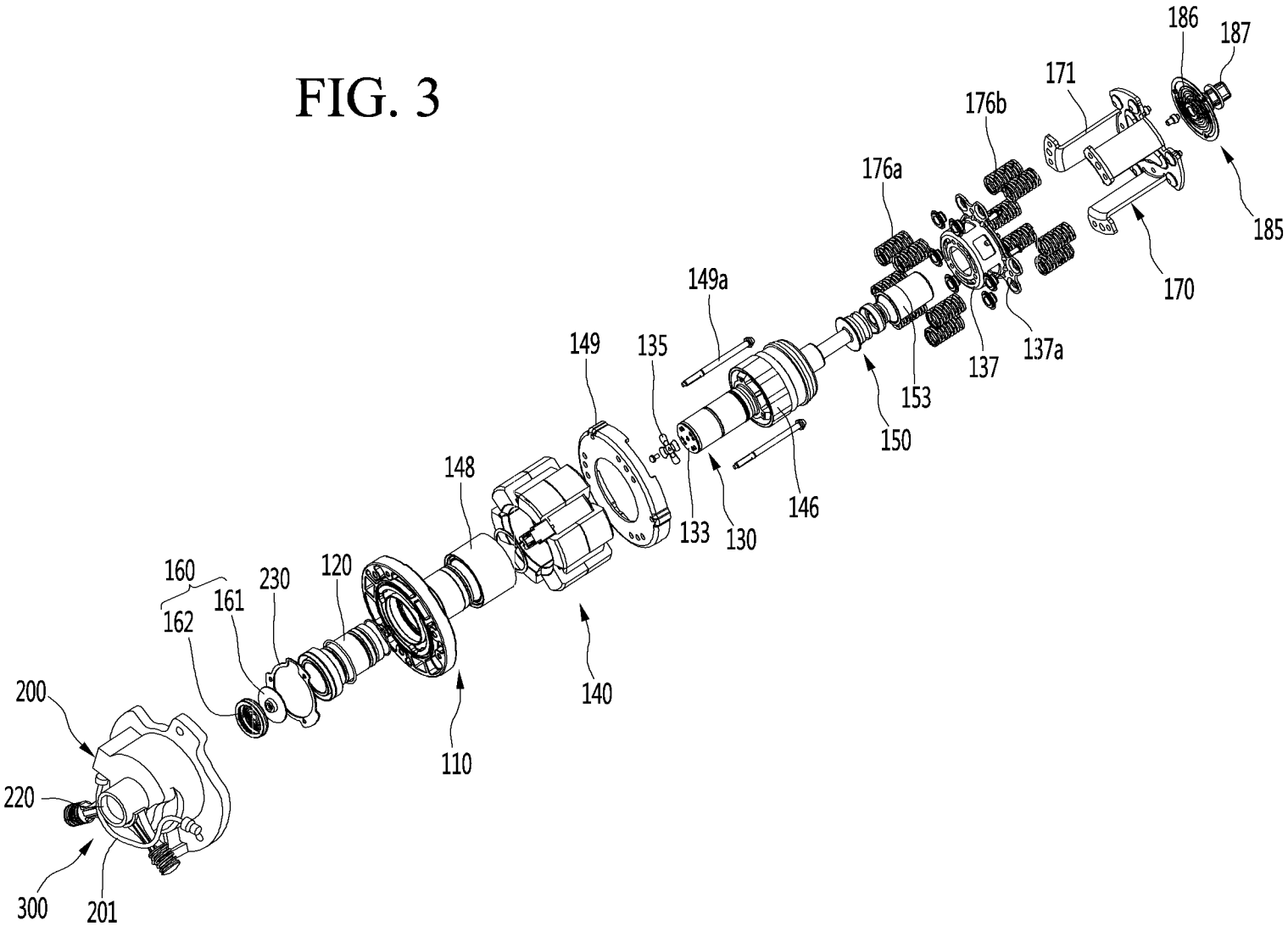
FIG. 3 is an exploded perspective view illustrating an example compressor body of the linear compressor of FIG. 1.
Figure 4:
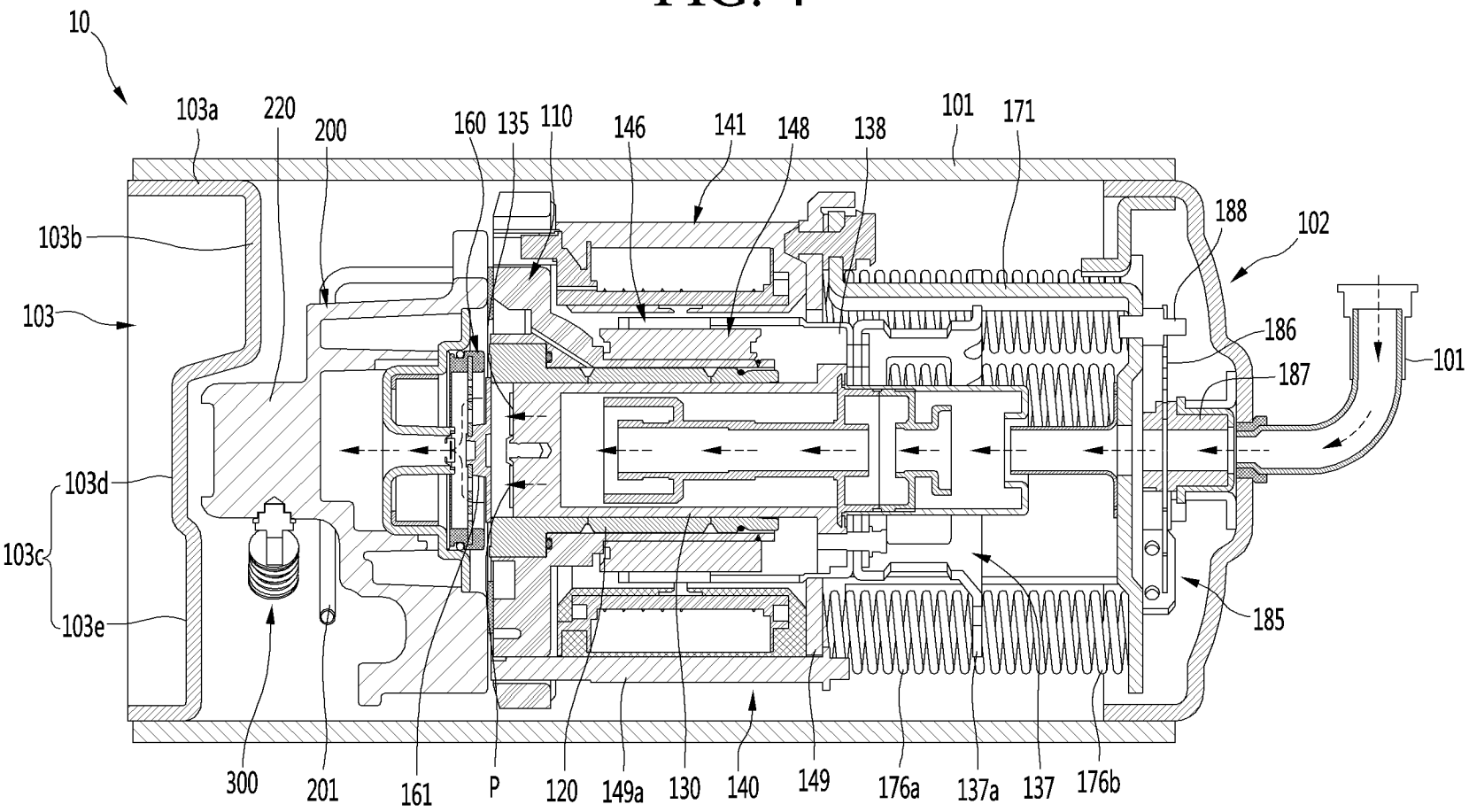
FIG. 4 is a cross-sectional view of the linear compressor of FIG. 1.
Figure 5:
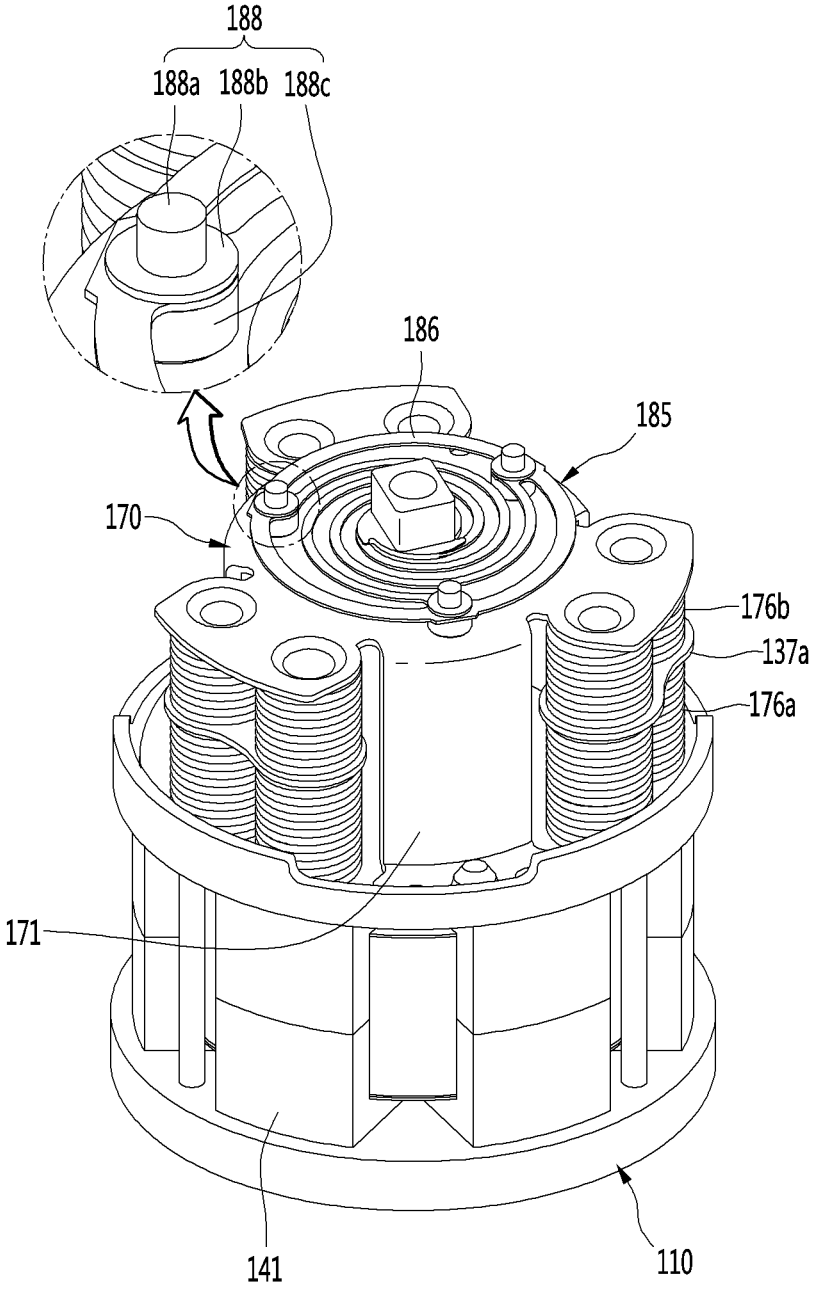
FIG. 5 is a perspective view illustrating an example first supporting damper mounted on the compressor body of FIG. 4.

FIG. 3 is an exploded perspective view illustrating an example compressor body that is a component of the linear compressor. FIG. 4 is a cross-sectional view of the linear compressor. FIG. 5 is a perspective view of the compressor body.

As illustrated in the drawings, the compressor body may be accommodated in the shell 101 in a state of being assembled. The compressor body includes a cylinder 120 disposed in the shell 101, a piston 130 that configured to linearly reciprocate within the cylinder 120, and a motor assembly that includes a linear motor configured to apply driving force to the piston 130. When the motor assembly 140 is driven, the piston 130 may linearly reciprocate in the axial direction of the cylinder 120.

The linear compressor 10 may further include a suction muffler 150 coupled to the piston 130 to reduce a noise generated from the refrigerant suctioned through the suction pipe 104. The refrigerant suctioned through the suction pipe 104 flows into the piston 130 via the suction muffler 150. For example, while the refrigerant passes through the suction muffler 150, the flow noise of the refrigerant may be reduced.

The suction muffler 150 may further include a muffler filter 153. The muffler filter 153 may have a cylindrical shape that accommodates one side of the suction muffler 150 and support the suction muffler 150.

The piston 130 may reciprocate within the cylinder 120, and a portion of the piston 130 may protrude outward from the cylinder 120. In some examples, the piston 130 may accommodate a portion of the suction muffler 150 and be coupled to the suction muffler 150 to reciprocate together with the suction muffler 150.

The cylinder 120 has a compression space P in which the refrigerant is compressed by the piston 130. In some examples, a suction hole 133 through which the refrigerant is introduced into the compression space P is defined in a front surface of the piston body 131, and a suction valve 135 for selectively opening the suction hole 133 is disposed on a front side of the suction hole 133.

A discharge cover 200 defining a discharge space for the refrigerant discharged from the compression space P and a discharge valve assembly 160 coupled to the discharge cover 200 to selectively discharge the refrigerant compressed in the compression space P are provided at a front side of the compression space P. The discharge space includes a plurality of spaces that are partitioned by an inner wall of the discharge cover 200. The plurality of spaces are defined in the front and rear direction to communicate with each other.

The discharge valve assembly 160 includes a discharge valve 161 opened when the pressure of the compression space P is above a discharge pressure to introduce the refrigerant into the discharge space and a valve elastic member 162 providing elastic force for elastically supporting the discharge valve 161.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve elastic member 162 may be deformed forward to open the discharge valve 161. Here, the refrigerant may be discharged from the compression space P into the discharge space of the discharge cover 200. When the discharge of the refrigerant is completed, the valve elastic member 162 may provide restoring force to the discharge valve 161 to close the discharge valve 161.

A loop pipe transferring the refrigerant discharged from the discharge cover 200 to the discharge pipe 105 is further provided at one side of the discharge cover 200.

The linear compressor 10 further includes a frame 110. The frame 110 may be configured to fix the cylinder 120, and the cylinder 120 may be press-fitted into the frame 110.

The frame 110 is disposed to surround the cylinder 120. That is, the cylinder 120 may be disposed to be accommodated into the frame 110. In some implementations, the discharge cover 200 may be coupled to a front surface of the frame 110 by using a coupling member.

The motor assembly 140 includes an outer stator 141 fixed to the frame 110 and disposed to surround the cylinder 120, an inner stator 148 disposed to be spaced inward from the outer stator 141, and a permanent magnet 146 disposed in a space between the outer stator 141 and the inner stator 148.

The permanent magnet 146 may linearly reciprocate by a mutual electromagnetic force between the outer stator 141 and the inner stator 148. In some implementations, the permanent magnet 146 may be provided as a single magnet having one polarity or be provided by coupling a plurality of magnets having three polarities to each other.

The permanent magnet 146 may be disposed on the magnet frame 138. The magnet frame 138 may have an approximately cylindrical shape and be disposed to be inserted into the space between the outer stator 141 and the inner stator 148. In some implementations, the magnet frame 138 may be coupled to the piston 130. When the permanent magnet 146 reciprocates, the piston 130 may reciprocate together with the permanent magnet 146 in the axial direction.

The outer stator 141 may include a coil winding body and a plurality of stator cores disposed along a circumference of the coil winding body. In some implementations, a stator cover 149 may be disposed on one side of the outer stator 141. That is, the outer stator 141 may have one side supported by the frame 110 and the other side supported by the stator cover 149.

The linear compressor 10 further includes a cover coupling member 149*a* for coupling the stator cover 149 to the frame 110. The cover coupling member 149*a* may be coupled so that both ends of the cover coupling member 149*a* respectively pass through the stator cover 149 and the frame 110.

In some examples, the inner stator 148 may be fixed to an outer circumference of the frame 110.

The linear compressor 10 further includes a support 137 for supporting the piston 130. The support 137 may be coupled to a rear portion of the piston 130, and the suction muffler 150 may be disposed to pass through the inside of the support 137. The piston 130, the magnet frame 138, and the support 137 may be coupled to each other by using a coupling member to integrally reciprocate together with each other. In some implementations, the support 137 includes a first spring support part 137*a* coupled to resonant springs 176*a* and 176*b*.

The linear compressor 10 further includes a rear cover 170 coupled to the stator cover 149 to extend backward and supported by the first supporting damper 185. The rear cover 170 includes three support legs, and the three support legs 171 may be coupled to a rear surface of the stator cover 149.

The linear compressor 10 further includes a plurality of resonant springs 176*a* and 176*b* that are adjusted in natural frequency to allow the piston 130 to perform a resonant motion. The plurality of resonant springs 176*a* and 176*b* include a first resonant spring 176*a* supported between the support 137 and the stator cover 149 and a second resonant spring 176*b* supported between the first resonant spring 176*a* and the rear cover 170. The driving part that reciprocates within the linear compressor 10 may stably move by the action of the plurality of resonant springs 176*a* and 176*b* to reduce the vibration or noise due to the movement of the driving part.

Referring to FIG. 4, a refrigerant flow in the linear compressor 10 will be described.

The refrigerant suctioned into the shell 101 through the suction pipe 104 is introduced into the piston 130 via the suction muffler 150. Here, the piston 130 reciprocates in the axial direction by the driving of the motor assembly 140.

When the suction valve 135 coupled to the front side of the piston 130 is opened, the refrigerant is introduced into the compression space P and then compressed. In some implementations, when the discharge valve 161 is opened, the compressed refrigerant is introduced into the discharge space of the discharge cover 200.

In detail, the refrigerant introduced into the discharge cover 200 may flow to pass through the plurality of spaces within the discharge cover 200 and be discharged from the discharge cover 200 through the loop pipe 612 and then discharged to the outside of the linear compressor 10 through the discharge pipe 105.

The compressor body provided in the shell 101 may be supported by the first supporting damper 185 and the second supporting damper 300, which are disposed on both the ends of the compressor body, in a state in which the compressor body is spaced apart from the inner wall of the shell 101. That is, the shell 101 and the compressor body within the shell 101 may be prevented from colliding with each other during the transportation and operation of the linear compressor 10.

In detail, the first supporting damper 185 may be mounted on the rear cover 170, and the rear end of the compressor body may be supported by the first supporting damper 185. In some implementations, the first supporting damper 185 may be coupled to the first shell cover 102 to elastically support the main body of the linear compressor 10.

The first supporting damper 185 includes an elastic plate 186. The elastic plate 186 may have the same shape as the plate spring. A plate fixing member 187 may be disposed at a center of the elastic plate 186, and three plate coupling members 188 may be disposed on an edge of the elastic plate 186.

The plate fixing member 187 may be inserted into the cover support part 102*a* disposed on the center of the first shell cover 102. In some implementations, the plate fixing member 187 may have a hollow central portion so that the refrigerant introduced into the suction pipe 104 passes through the plate fixing member 187 to flow to the suction muffler 150. Thus, the plate fixing member 187 may be made of an elastic material such as rubber and press-fitted into the support part 220 so as to be maintained in the fixed state. In some implementations, the plate fixing member 187 may allow the introduced refrigerant to flow to the suction muffler 150 without leakage.

The plate coupling members 188 may be disposed along the edge of the elastic plate 186 at the same interval. The plate coupling member 188 may include a rubber member 188*c* supporting the elastic plate 186, a bolt 188*a* coupled to pass through the elastic plate 186 and the rubber member 188*c*, and a washer 188*b* preventing the bolt 188*a* from being released. The first supporting damper 185 may be fixed to the rear cover 170 by the coupling of the plate coupling member 188.

Thus, the first supporting damper 185 may be configured so that the compressor body is fixed to the first shell cover 102 and buffer the vibration or impact occurring during the operation of the linear compressor 10 to reduce resultant noise.

A stopper 102*b* may be disposed on the inner surface of the first shell cover 102. The stopper 102*b* may be understood as a component for preventing the main body of the linear compressor 10, particularly, the motor assembly 140 from colliding with the shell 101 and thus being damaged due to the vibration or impact occurring during the transportation of the linear compressor 10.

The stopper 102*b* may protrude from a position adjacent to the rear cover 170. Thus, when the linear compressor 10 is shaken, the rear cover 170 may interfere with the stopper 102*b* to prevent the impact from being applied to the motor assembly 140.

The linear compressor 10 further includes the second supporting damper 300 coupled to the discharge cover 200 to support one side of the main body of the linear compressor 10. The second supporting damper 300 may be disposed adjacent to the second shell cover 103 to elastically support the front end of the compressor body.

The second supporting damper 300 may support a portion between the discharge cover 200 and the shell 101 to buffer the impact and vibration during the transportation or operation of the linear compressor 10. The second supporting damper 300 may have a buffering effect that is relatively larger than that of the first supporting damper 185. Thus, the rear end of the compressor body may be firmly fixed. On the other hand, the front end of the compressor body may be relatively flexible support structure to provide an effective buffering support structure of the compressor body.

In some implementations, the center accommodation part 193*d* may accommodate the support part 220 of the discharge cover 200 in the state in which the second shell cover 103 is mounted to limit the upward movement of the discharge cover 200. In some implementations, the discharge cover 200 and the compressor body including the discharge cover 200 may be limited in downward movement and left and right movement by the second supporting damper 300.

Hereinafter, a structure of the second supporting damper 300 will now be described in more detail with reference to the accompanying drawings.

Figure 6:
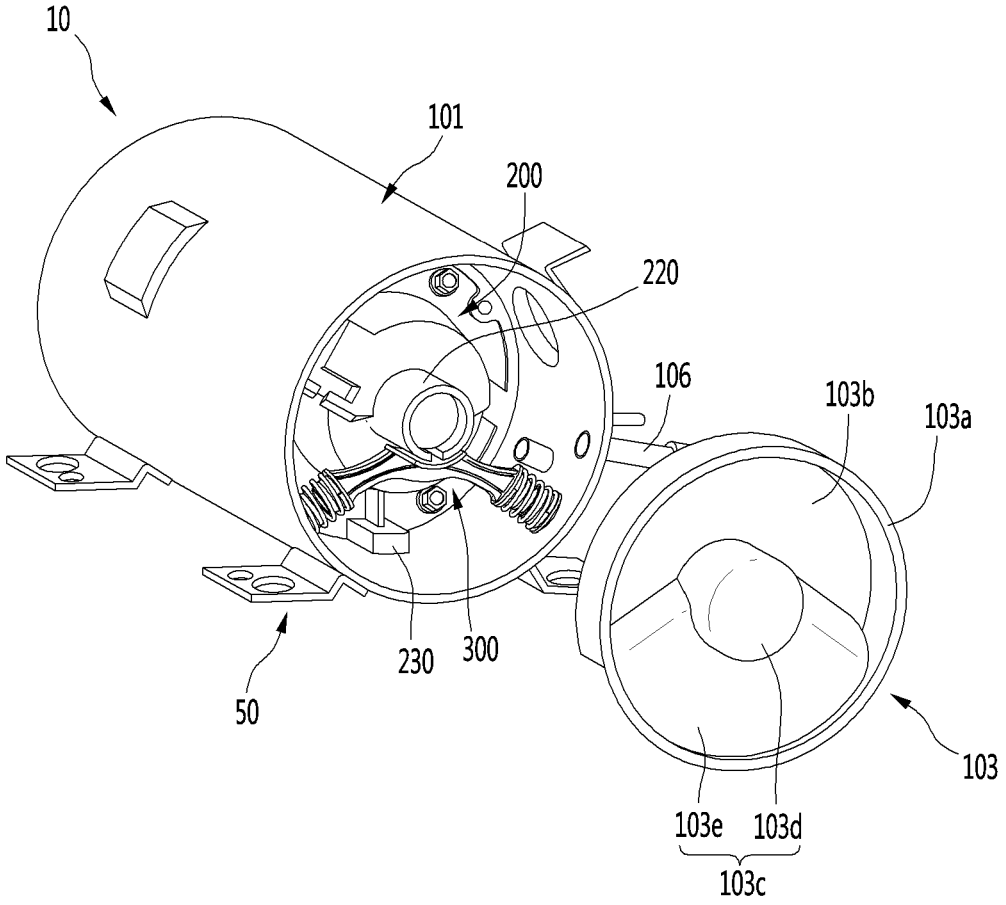
FIG. 6 is an exploded perspective view illustrating an example shell and an example second shell cover separated from the shell.
Figure 7:
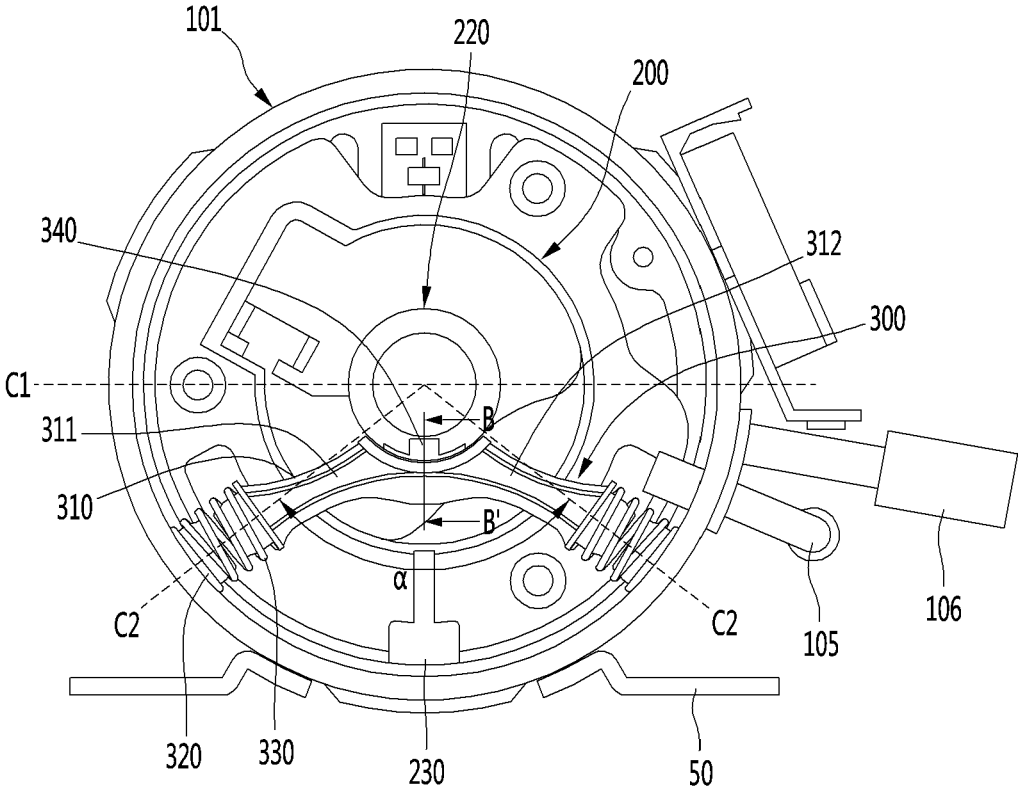
FIG. 7 is a side view of the linear compressor with the second shell cover being removed.

FIG. 6 is an exploded perspective view illustrating an example state in which the second shell cover of the linear compressor is separated from the shell. FIG. 7 is a side view of the linear compressor from which the second shell cover is removed.

As illustrated in the drawings, the second supporting damper 300 may be mounted behind the center of the discharge cover 200, i.e., the support part 220 protruding to the second shell cover 103. In some implementations, the second supporting damper 300 may extend to the inner surface of the shell 101 with respect to the support part 220. Here, the second supporting damper 300 may be supported at one point by the support part 220 and supported at two points by the shell 101. Thus, the vibration of the compressor body may be uniformly dispersed and transmitted to the shell 101 through the second supporting damper 300.

The second supporting damper 300 may be disposed below a horizontal central line C1 of the linear compressor 10, i.e., be disposed to face the mounting leg 50. In some implementations, the second supporting damper 300 may be branched to both left and right sides from the outside of the support part 220 by the same length and come into contact with the inner surface of the shell 101 in a state in which the branched portions of the second supporting damper 300 extend to a position that is spaced a predetermined angle from each other. Thus, the support part 220, i.e., one end of the compressor body may be stably supported at the lower side. In the case of the linear compressor 10, since the mounting leg 50 is disposed on the bottom of the installation space, a load of the compressor body may be applied downward. In this state, the load applied downward may be supported by the second supporting damper 300, and In some implementations, the vibration may be transmitted in the operating state.

The second supporting damper 300 may generally include a supporting leg 310 coupled to the support part 220 to extend to both sides, a pair of contact members 320 coming into contact with the inner surface of the shell 101, and an elastic member 330 connecting the supporting leg 310 to each of the contact members 320.

The supporting leg 310 may be made of a plastic material and have a symmetrical shape. The supporting leg 310 may be coupled to a bottom surface of the support part 220 and constituted by a first leg part 311 and a second leg part 312, which are symmetrical to each other with respect to a center of the supporting leg 310. In some implementations, the first leg part 311 and the second leg part 312 may be separately provided and then coupled to each other.

The first leg part 311 and the second leg part 312 may have a shape that is symmetrical to each other in both left and right directions when viewed in FIG. 7. For example, the second supporting damper 300 may be a single body having a V-shape, where the seating part 313, the first leg part 311, and the second leg part 312 are parts of the single body. The first leg part 311 and the second leg part 312 may be spaced a set angle $\alpha$ from each other. Here, the set angle $\alpha$ may refer to an angle between an extending end of each of the first leg part 311 and the second leg part 312 or an end of the second supporting damper 300 coming into contact with the shell 101 and the extension line connecting the center of the support part 220.

The set angle $\alpha$ may be within a range between a minimum angle and a maximum angle, so that the load and the vibration of the compressor body are uniformly dispersed and transmitted to both left and right sides. Thus, the compressor body may be maintained to be stably supported. For example, in some implementations, the range of the angle $\alpha$ may be from a minimum angle of about 90° to a maximum angle of about 120°.

If the set angle $\alpha$ is outside of the range between the minimum and maximum angles, then vibrations of the compressor body may cause variations in the distance between the inner surface of the shell 101 and the outer surface of the compressor body or the discharge cover 200. For example, if the set angle $\alpha$ is less than the minimum angle, then in some scenarios, vibrations in the lateral (left and right) directions may not be effectively damped and may instead increase. As another example, if the set angle $\alpha$ is greater than the maximum angle, then vibrations in the vertical (up and down) direction may not be effectively damped.

As a particular example, the set angle $\alpha$ may be about 108°. When disposed at this angle, the inner surface of the shell 101 and the outer surface of the compressor body may be maintained at a proper angle with respect to each other to provide the stable supporting state.

A central line vertically extending from a center of the supporting leg 310 may be disposed in the same extension line as the central line of the shell 101. For example, the central line of the shell 101 may pass through a center of the support part 220 and a center of the seating part 313 of the supporting leg 310. In this structure, the load and vibration of the compressor body in the left and right direction and the vertical direction may be stably effectively damped by the second supporting damper 300.

The supporting leg 310 is disposed below the support part 220 to stably support the support part 220. Thus, the first leg part 311 and the second leg part 312 may not be disposed in the same extension line as the contact member. The first leg part 311 and the second leg part 312 may be disposed to be further inclined downward than the extension line C2 connecting the contact member 320 to the support part 220.

In some implementations, a reinforcement part having a thicker thickness so as to endure the load that is vertically applied may be further provided on a position at which the first leg part 311 and the second leg part 312 are connected to each other. An upper end of the supporting leg 310 facing the reinforcement part may be coupled to the support part 220, and a seating member 340 for buffering and sealing may be further provided between the support part 220 and the supporting leg 310.

Figure 8:
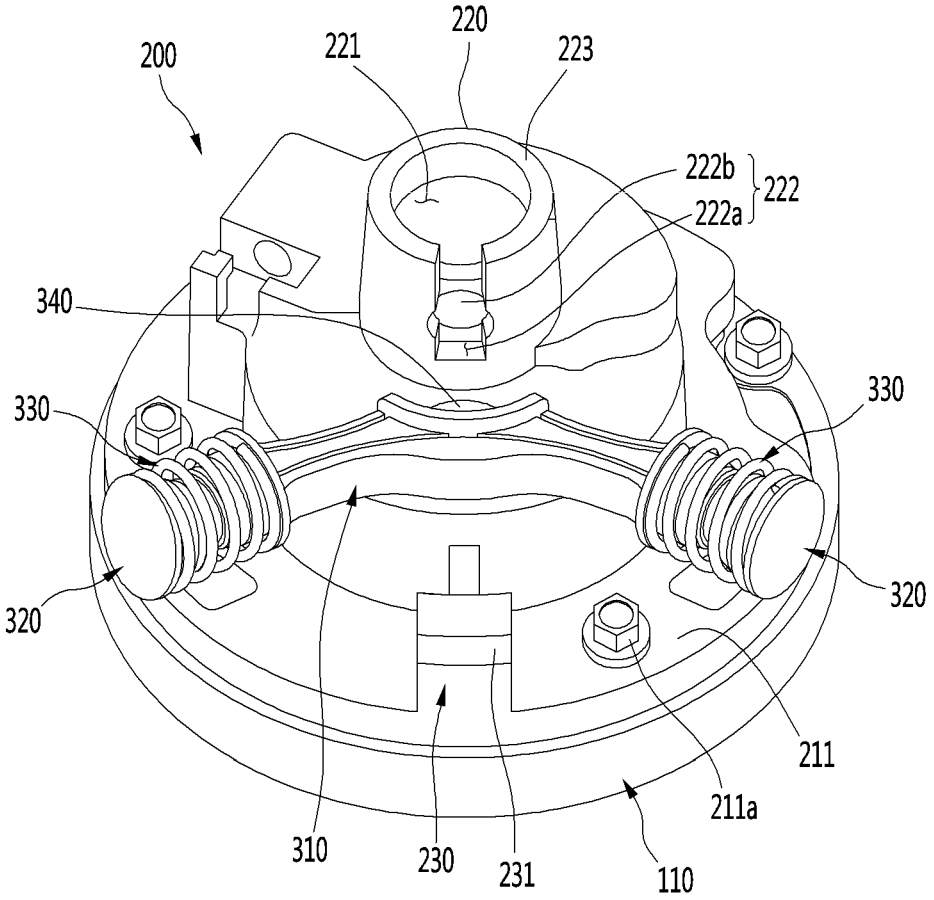
FIG. 8 is an exploded perspective view illustrating an example coupling structure of an example discharge cover and an example second supporting damper of the linear compressor.
Figure 9:
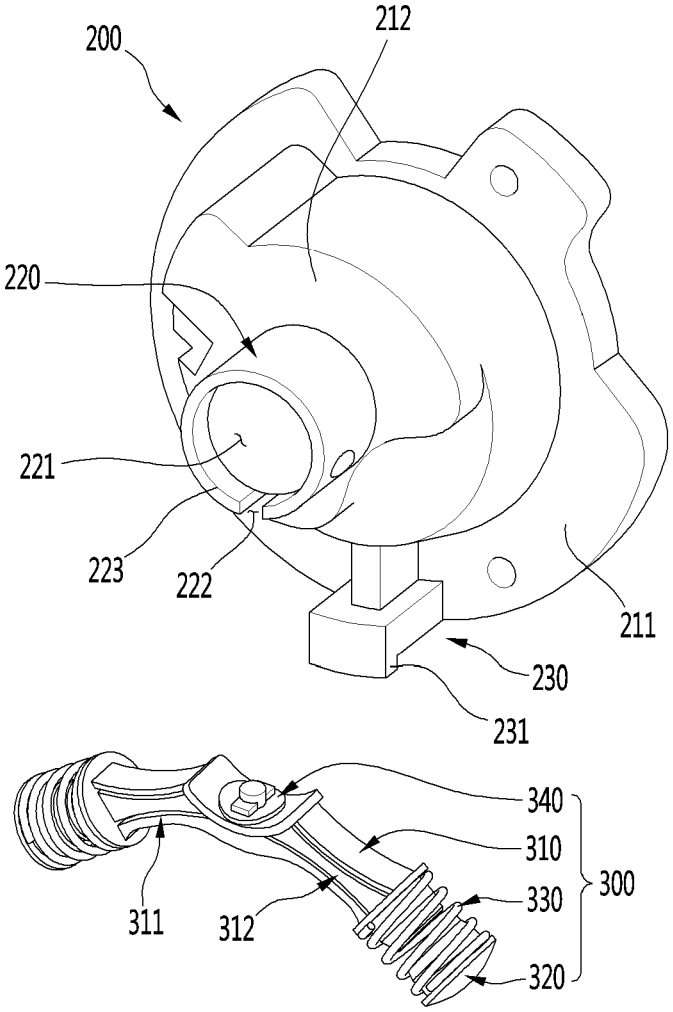
FIG. 9 is an exploded perspective view illustrating the coupling structure of the discharge cover and the second supporting damper viewed from another side of FIG. 8.

FIG. 8 is an exploded perspective view illustrating an example coupling structure of the discharge cover and the second supporting damper of the linear compressor when viewed from one side. FIG. 9 is an exploded perspective view illustrating the coupling structure of the discharge cover and the second supporting damper when viewed from the other side.

As illustrated in the drawings, the discharge cover 200 may be made of a metal material and have a structure that is stepped in a multistage to provide a plurality of spaces, in which the refrigerant is accommodated.

A cover base 211 may be disposed on the bottom surface of the discharge cover 200. The cover base 211 may come into contact with a front end of the frame 110. In some implementations, the discharge cover 200 may be firmly coupled to the frame 110 by a plurality of cover coupling members 211*a* coupled along an edge of the cover base 211.

In some implementations, a cover protrusion 212 protruding forward may be disposed on a front surface of the cover base 211. A space having a recessed shape may be provided in the cover protrusion 212 to accommodate the refrigerant, and the refrigerant may pass through the plurality of spaces while flowing. The cover protrusion 212 may be stepped in multistage when the inner space of the cover protrusion 212 is divided into the plurality of spaces.

A support part 220 may be provided on the frontmost end of the discharge cover 200, i.e., a front surface of the cover protrusion 212. In some implementations, the support part 220 may be formed integrally with the discharge cover 200 when the discharge cover 200 is formed. In other words, the support part 200 and the discharge cover 200 may be portions of a single body. In other implementations, the support part 200 may be separately provided and then coupled to the discharge cover 200. In some implementations, the support part 220 may be coupled to other components of the front end of the compressor body, but the discharge cover 200.

The support part 220 may have a cylindrical shape and may be substantially disposed on the frontmost end of the compressor body to extend to be adjacent to the second shell cover 103. For example, the support part 220 is disposed at a position closer to an inner surface of the second shell cover 103 than any other parts of the compression body. In some implementations, the support part 220 may have a shape that is capable of being accommodated in the inner space of the center accommodation part 103*d* in the state in which the second shell cover 103 is mounted.

The support part 220 may be disposed on the central portion when the compressor body is viewed from the front. In some implementations, the support part 220 may be disposed in the same extension line as the plate fixing member 187 of the first supporting damper 185.

A support part groove 221 that is recessed inward may be defined in a front end of the support part 220, and a support part edge 223 that protrudes forward may be disposed on a circumference of the support part groove 221. The support part edge 223 may define a support part end surface that faces the second shell cover 103. The support part edge 223 may be substantially disposed on the frontmost end of the compressor body. For example, the support part edge 223 is disposed at a position closer to the inner surface of the second shell cover 103 than any other parts of the compression body. When the compressor body moves forward and backward, the support part edge 223 may come into contact with the inner portion of the center accommodation part 103*d* of the second shell cover 103. In some implementations, only the support part edge 223 may come into contact with the second shell cover 103 by the recessed support part groove 221 to minimize the impact due to the contact with the second shell cover 103.

A damper mounting part 222 may be disposed on a bottom surface, on which the second supporting damper 300 is mounted, of a circumferential surface of the support part 220. The damper mounting part 222 may be opened downward so that an upper end of the second supporting damper 300 or a portion of the seating member 340 seated on the upper end of the second supporting damper 300 is inserted.

The damper mounting part 222 may be provided in a cut shape in the front end of the support part 220. Thus, when the second supporting damper 300 is inserted forward, the coupling protrusion 314 may be inserted through the opened front end of the damper mounting part 222.

The damper mounting part 222 may have a first mounting groove 222*a* lengthily extending in the same direction as the protrusion direction of the support part 220. The first mounting groove 222*a* may have an opening having a rectangular shape, which corresponds to each of a first protrusion 314*a* and a first insertion part 342, which will be described below. Each of the first protrusion 314*a* and the first insertion part 342 may be inserted into the first mounting groove 222*a*.

In some implementations, a second mounting groove 222*b* may be defined in a center of the first mounting groove 222*a*. The second mounting groove 222*b* may be further recessed from the central portion of the first mounting groove 222*a* and have a circular cross-section different from that of the first mounting groove. In some implementations, each of a second protrusion 314*b* and a second insertion part 343, which will be described below, may be inserted and fixed to the second mounting groove 222*b*.

Due to this structure, the second supporting damper 300 may have a dual restriction structure so that the second supporting damper 300 does not move in the state of being mounted. In some implementations, even though the vibration is transmitted, the second supporting damper 300 may be firmly fixed to the outer surface of the support part 220 without being twisted or causing a gap therebetween.

In some implementations, the first mounting grooves 222*a* defined both sides with respect to the second mounting groove 222*b* may have sizes or shapes different from each other. Thus, when a worker mounts the first supporting damper 185, the first supporting damper 185 may have directivity to prevent the second supporting damper from being erroneously mounted and to be mounted in the correct direction.

A side stopper 230 protruding forward may be disposed on a lower end of the discharge cover 200 facing the support part 220. The side stopper 230 may extend forward from an outer end of the cover base 211 and be disposed between the mounting legs 50, which is disposed vertically below the support part 220, i.e., both sides of the support part 220. For instance, the side stopper 230 is spaced apart from a first leg part 311 of the second supporting damper 300 by a first angle and spaced apart from a second leg part 312 of the second supporting damper 300 by a second angle. In some cases, the first angle and the second angle are identical.

In some implementations, a stopping protrusion 231 protruding to the inner surface of the shell 101 may be further disposed on a lower end of the side stopper 230. The side stopper 230 may prevent the compressor body from excessively moving when the second supporting damper 300 is damaged and thus does not buffer the vibration of the compressor body or in a state in which the compressor body is supported by the second supporting damper 300.

The stopping protrusion 231 may protrude most from the outer surface of the compressor body and protrude further than other portions of the circumference of the discharge cover 200. In some implementations, the stopping protrusion 231 may come into contact with the shell 101 to prevent other components of the compressor body from colliding with the shell 101 when the compressor body moves.

Figure 10:
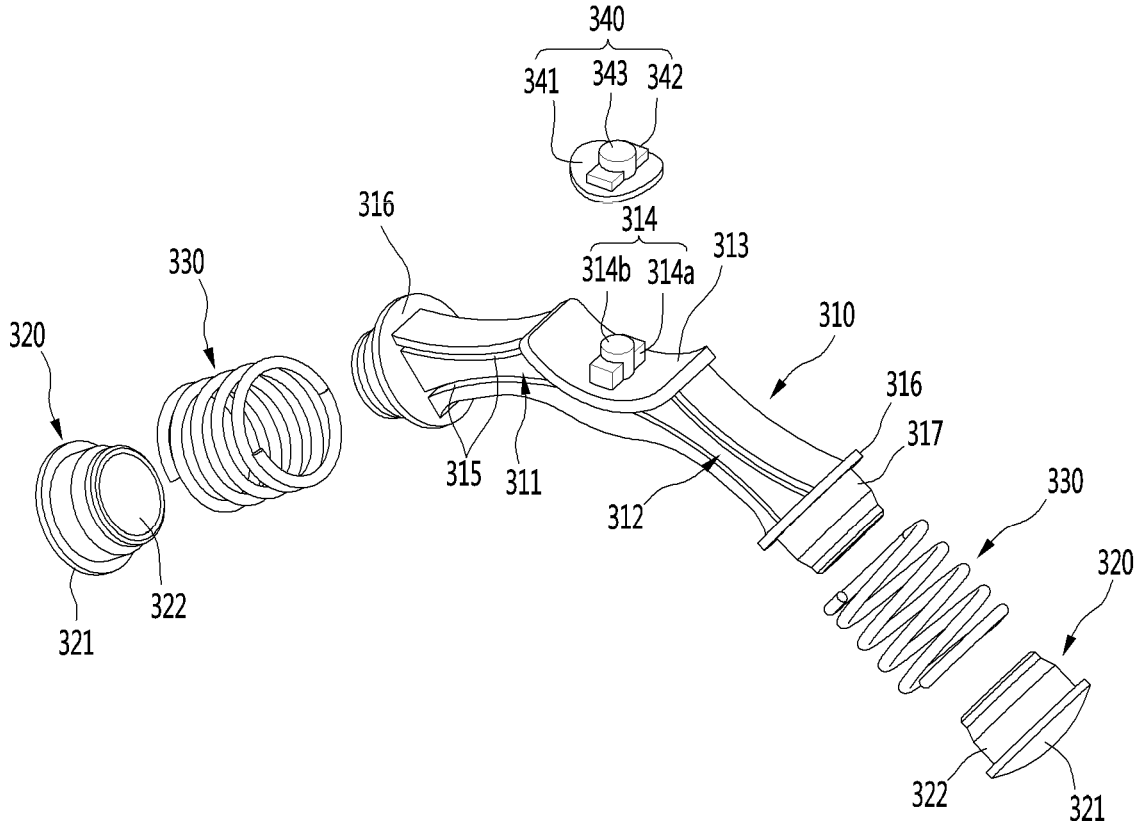
FIG. 10 is an exploded perspective view illustrating the second supporting damper.

FIG. 10 is an exploded perspective view of the second supporting damper.

Referring to the drawing, the second supporting damper 300 may include a supporting leg 310, an elastic member, a contact member 320, and a seating member 340.

The supporting leg 310 may be injection molded by using a plastic material. The supporting leg 310 may have a shape that is symmetrical to each other in both left and right directions with respect to a center thereof. The supporting leg 310 may include a first leg part 311 and a second leg part 312, which extend to both left and right sides.

Each of the first leg part 311 and the second leg part 312 may have a predetermined length and have a shape of which a central portion is narrow and extends and which gradually increases in width toward both ends thereof. Thus, a load transmitted to a center of the supporting leg 310 may be dispersed and transmitted to the inner surface of the shell 101 through the first leg part 311 and the second leg part 312. In some implementations, a groove 315 that is recessed in the extension direction may be defined in each of the first leg part 311 and the second leg part 312 to prevent the supporting leg 310 from being contracted and deformed when the supporting leg 310 is injection molded.

In some implementations, the seating part 313 may be disposed on a center of a top surface of the supporting leg 310 connecting the first leg part 311 to the second leg part 312. The seating part 313 may have a curved shape. That is, the seating part 313 may have a corresponding curved shape so as to be closely attached to an outer surface of the support part 220. For example, the seating part 313 and the outer surface of the support part 220 may contact each other or may be disposed at positions less than a preset distance.

In some implementations, a reinforcement part protruding downward in the same direction as the direction in which the seating part 313 is recessed may be disposed on an opposite side of the supporting leg 310 facing the seating part 313. The reinforcement part may have a predetermined thickness to endure the load transmitted through the support part 220. In some implementations, the first leg part 311 and the second leg part 312 may be disposed on both sides with respect to the seating part 313 and the reinforcement part to uniformly disperse and transmit the vibration and load, which are transmitted through the support part 220, to the first leg part 311 and the second leg part 312.

A coupling protrusion 314 may be disposed at a center of the seating part 313. The coupling protrusion 314 may have a shape corresponding to a position facing the damper mounting part 222 of the support part 220. The coupling protrusion 314 may include a first protrusion 314*a* inserted into the first mounting groove 222*a* and a second protrusion 314*b* inserted into the second mounting groove 222*b*.

The first protrusion 314*a* may be lengthily disposed in a front and rear direction and have a rectangular shape. In some implementations, the second protrusion 314*b* may further protrude from a center of the first protrusion 314*a*. The second protrusion 314*b* may have a circular cross-section unlike the first protrusion 314*a*. Thus, the first protrusion 314*a* and the second protrusion 314*b* may be respectively coupled to the first mounting groove 222*a* and the second mounting groove 222*b* so that the second supporting damper 300 is fixed and mounted on the support part 220.

In some implementations, the seating member 340 may be mounted on the seating part 313. The seating member 340 may be made of an elastic material such as rubber or silicon. When the second supporting damper 300 is mounted, the seating member 340 may be disposed between the seating part 313 and the support part 220.

The seating member 340 may include a sheet part 341 closely attached to the seating part 313 and first and second insertion parts 342 and 343 protruding from the sheet part 341. For example, the sheet part 341 and the seating part 313 may contact each other or may be disposed at positions less than a preset distance. Each of the first and second insertion parts 342 and 343 may have a shape corresponding so that the first protrusion 314*a* and the second protrusion 314*b* are correspondingly inserted. Thus, in the state in which the seating member 340 is seated on the seating part 313, the first protrusion 314*a* and the second protrusion 314*b* may be in a state of being inserted into the first insertion part 342 and the second insertion part 343. In some implementations, in the state in which the seating member 340 is seated on the seating part 313, the first insertion part 342 and the second insertion part 343 may be inserted into the first mounting groove 222*a* and the second mounting groove 22*b*.

That is, in the state in which the second supporting damper 300 is mounted on the support part 220, the seating member 340 may be closely attached to the inside of the damper mounting part 222 and be fixed to the support part 220 without movement of the supporting leg 310. In some implementations, the support part 220 may primarily attenuate the vibration transmitted to the supporting leg 310 through the seating member 340.

A leg-side support part 316 and a leg-side fixing part 317, which are configured to mount the elastic member 330, may be disposed on both ends of the supporting leg 310. The leg-side support part 316 may have a plate shape extending outward along a circumference of the supporting leg 310. When the elastic member 330 is mounted, the leg-side support part 316 may support one end of the elastic member 330. In some implementations, the leg-side fixing part 317 may be inserted into the elastic member 330 to prevent the elastic member 330 from being separated and may extend from the leg-side support part 316 toward the elastic member 330.

The leg-side fixing part 317 may have an outer diameter corresponding to an inner diameter of the elastic member 330. In some implementations, an extending end of the leg-side fixing part 317 may be inclined or rounded so that the elastic member 330 is easily mounted.

The elastic member 330 may connect the supporting leg 310 to the contact member 320 to provide elastic force so that the contact member 320 is pressed and contacted to the inner surface of the shell 101. For example, in some implementations, the elastic member 330 may provide the elastic force so that the contact member 320 is maintained in state of being always pressed and contacted to the inner surface of the shell 101. In some cases, vibration of the compressor body may be attenuated by the elastic member 330, and thus, the vibration and impact transmitted to the shell 101 may be mitigated. The elastic member 330 may have a coil spring shape so that the outer surface of the compressor body is maintained at a set gap with respect to the inner surface of the shell 101.

The contact member 320 may come into contact with the inner surface of the shell 101 and include a contact member-side fixing part 322 fixed to an end of the elastic member 330 and a contact part 321 coming into contact with the shell 101. The contact member-side fixing part 322 may be inserted into the elastic member 330 to prevent the elastic member 330 from being separated and may extend from the contact part 321 toward elastic member 330. The contact member-side fixing part 322 may have an outer diameter corresponding to an inner diameter of the elastic member 330. In some implementations, an extending end of the contact member-side fixing part 322 may be inclined or rounded so that the elastic member 330 is easily mounted.

The contact part 321 may be disposed on an end of the contact member-side fixing part 322 and have a diameter greater than that of the contact member-side fixing part 322. Thus, the end of the elastic member 330 in the state in which the contact member-side fixing part 322 is inserted may be supported on one surface of the contact part 321.

In some implementations, the other surface facing the inner surface of the shell 101 may be rounded. Thus, a curved surface of the contact part 321 may come into contact with the inner surface of the shell 101. Even though the contact part 321 is shaken by the vibration of the compressor body, the inner surface of the shell 101 and the contact part 321 may be maintained in the point contact state to transmit the vibration of the compressor body to the shell 101. In some implementations, even though the supporting leg 310 that is spaced apart from the contact member 320 is shaken to transmit the vibration to the contact member 320, the contact part 321 may be maintained in the state of coming into constant contact with the inner surface of the shell 101. Thus, the vibration may be effectively transmitted.

Figure 11:
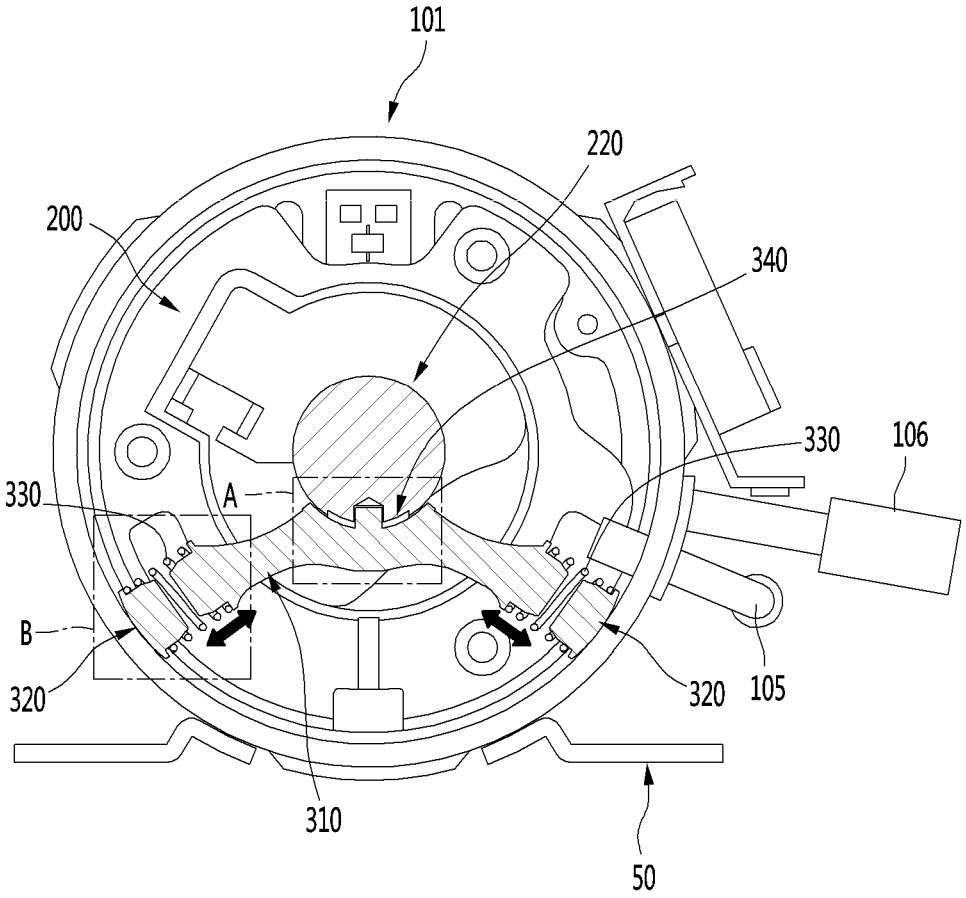
FIG. 11 is a cross-sectional view illustrating an example of a mounted state of the second supporting damper.
Figure 12:
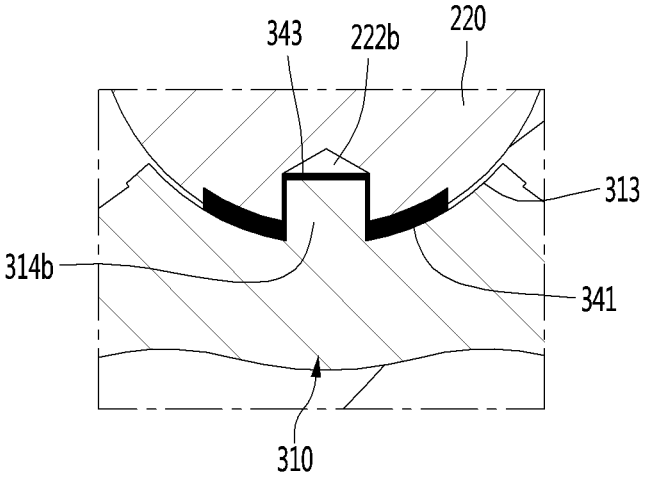
FIG. 12 is an enlarged view illustrating the portion A of FIG. 11.
Figure 13:
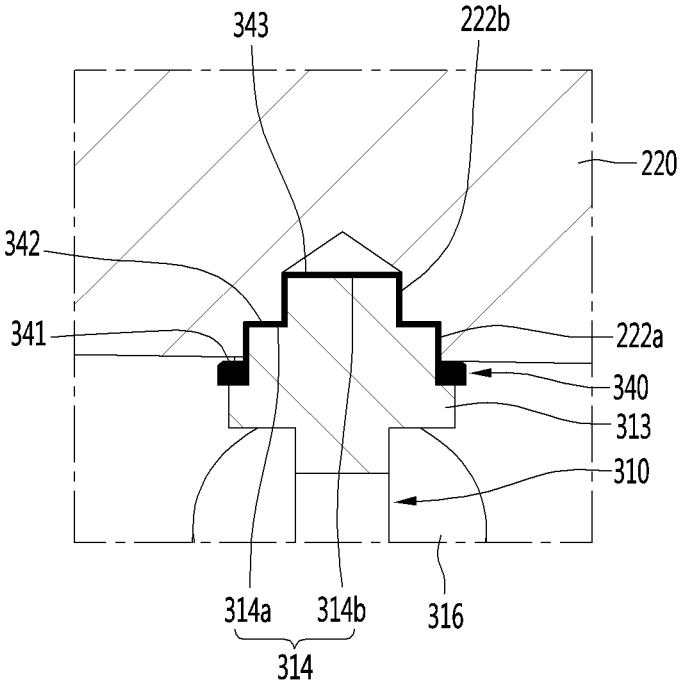
FIG. 13 is a cross-sectional view taken along line B-B' of FIG. 7.
Figure 14:
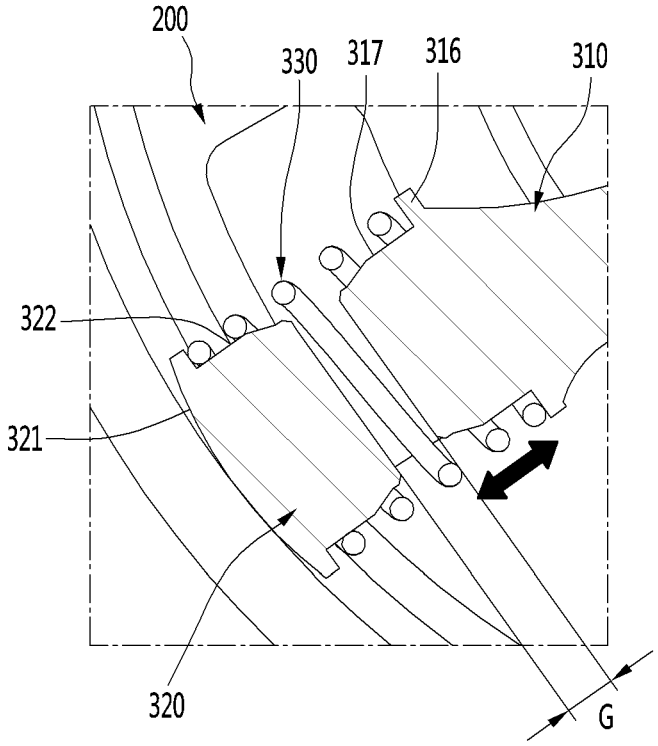
FIG. 14 is an enlarged view illustrating the portion B of FIG. 11.

FIG. 11 is a cross-sectional view illustrating an example of a mounted state of the second supporting damper. FIG. 12 is an enlarged view illustrating the portion A of FIG. 11. FIG. 13 is a cross-sectional view taken along line B-B' of FIG. 7. FIG. 14 is an enlarged view illustrating the portion B of FIG. 11.

The mounted structure of the second supporting damper 300 will be described in more detail with reference to the accompanying drawings. As illustrated in FIGS. 12 and 13, the second supporting damper 300 may be coupled to the support part 220 in the state in which the seating member 340 is seated on the seating part 313 of the supporting leg 310.

Here, the seating member 340 may be elastically deformed to allow the seating part 313 having the curved shape to be closely attached to the outer surface of the support part 220. In some implementations, the seating member 340 may be press-fitted into the first mounting groove 222*a* and the second mounting groove 222*b* so that the second supporting damper 300 is more firmly fixed. In some implementations, the vibration and impact transmitted to the second supporting damper 300 may be primarily buffered through the support part 220.

In some implementations, the first protrusion 314*a* and the second protrusion 314*b* of the supporting leg 310 may have heights different from each other and be respectively inserted into the first mounting groove 222*a* and the second mounting groove 222*b*.

In some implementations, the first insertion part 342 and the second insertion part 343 of the seating member 340 may be closely attached to the outer surface of each of the first protrusion 314*a* and second protrusion 314*b* and the inner surface of each of the first mounting groove 222*a* and the second mounting groove 222*b*, respectively.

Here, the first insertion part 342 and the second insertion part 343 are coupled to be pressed, and thus, the second supporting damper 300 may be firmly fixed to the support part 220. Thus, the second supporting damper 300 may be maintained in mounted position and state without rotating even though the vibration and impact are applied in the state of being mounted on the support part 220.

As illustrated in FIG. 14, in the state in which the second supporting damper 300 is mounted, the contact member 320 may come into contact with the inner surface of the shell 101 by the pressing of the elastic member 330. Here, the contact member 320 and the supporting leg 310 may be separated from each other and be connected to each other by the elastic member 330.

In some implementations, in the state in which the second supporting damper 300 is mounted, the elastic member 330 may be disposed inside the shell 101 in the pressed state. Thus, the compressor body supported by the second supporting damper 300 and the inner surface of the shell 101 may be maintained at a predetermined gap.

In detail, in the state in which the elastic member 330 connects the contact member 320 to the supporting leg 310 in the pressed state, the end of the contact member 320 and the end of the supporting leg 310 may be maintained at a set gap G.

The second supporting damper 300 may be deflected in the gravity direction by the load of the compressor body due to the characteristics of the mounting structure. In this state, the contact member 320 and the end of the supporting leg 310 may be maintained at the set gap so as to effectively attenuate the vibration during the transportation or operation of the linear compressor 10, according to some implementations.

In some implementations, the set gap G may be equally applied between the ends of the first and second leg parts 311 and 312, which are disposed on both left and right sides, and the contact member 320. Thus, the compressor body may be stably mounted at the central portion without being biased or eccentric to any one side.

In some implementations, the elastic member 330 may have a set elastic modulus to maintain the set gap G. Here, the elastic modulus of the elastic member 330 may be determined according to the load of the compressor body and the size of the shell 101.

For example, when the set gap between the contact member 320 and the end of the supporting leg 310 is set to about 1.8 mm, the elastic modulus of the elastic member 330 may be about 0.339 kgf/mm.

When the set gap between the contact member 320 and the end of the supporting leg 310 is less or greater than a predetermined value, an adequate gap between the compressor body and the shell 101 may not be maintained. Thus, the vibration noise during the transportation or operation of the linear compressor 10 may increase.

The linear compressor 10 may be transported for the installation in the assembled state. Here, the impact during the transportation may occur. In some implementations, the linear compressor 10 may generate vibration caused by the movement of the components for driving such as the piston 130, which reciprocates at a high speed.

Hereinafter, the vibration and impact reduction of the linear compressor having the above-described structure will be described.

Figure 15:
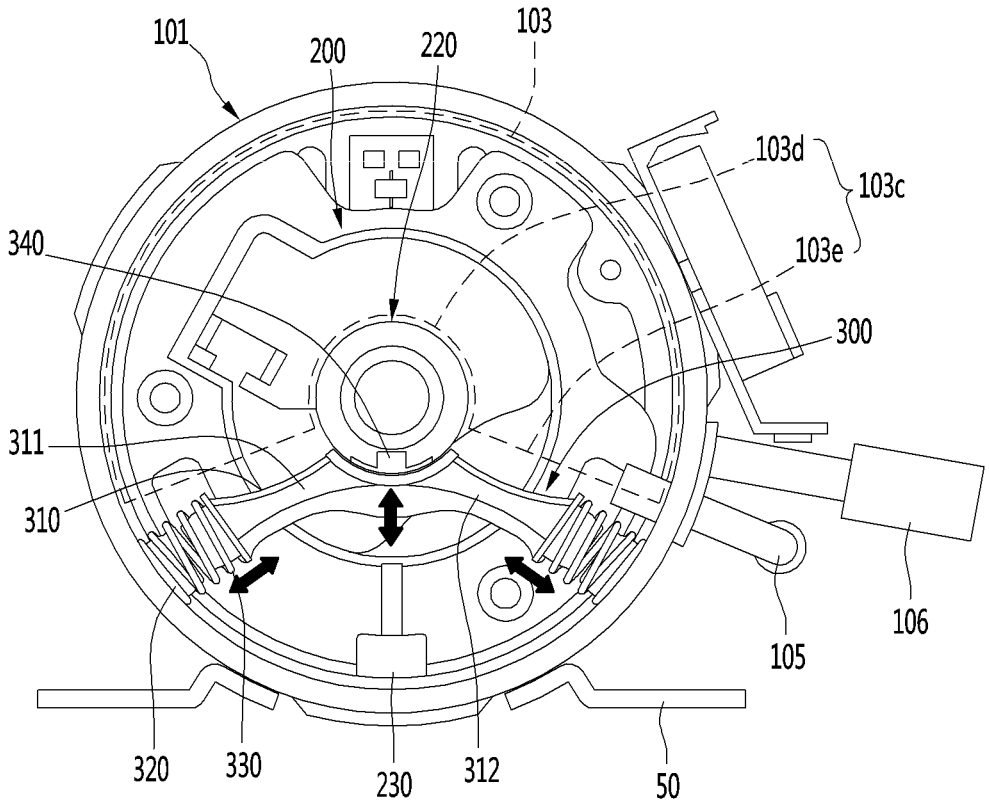
FIG. 15 is a view illustrating an example of transmission of vibration of the compressor body.
Figure 16:
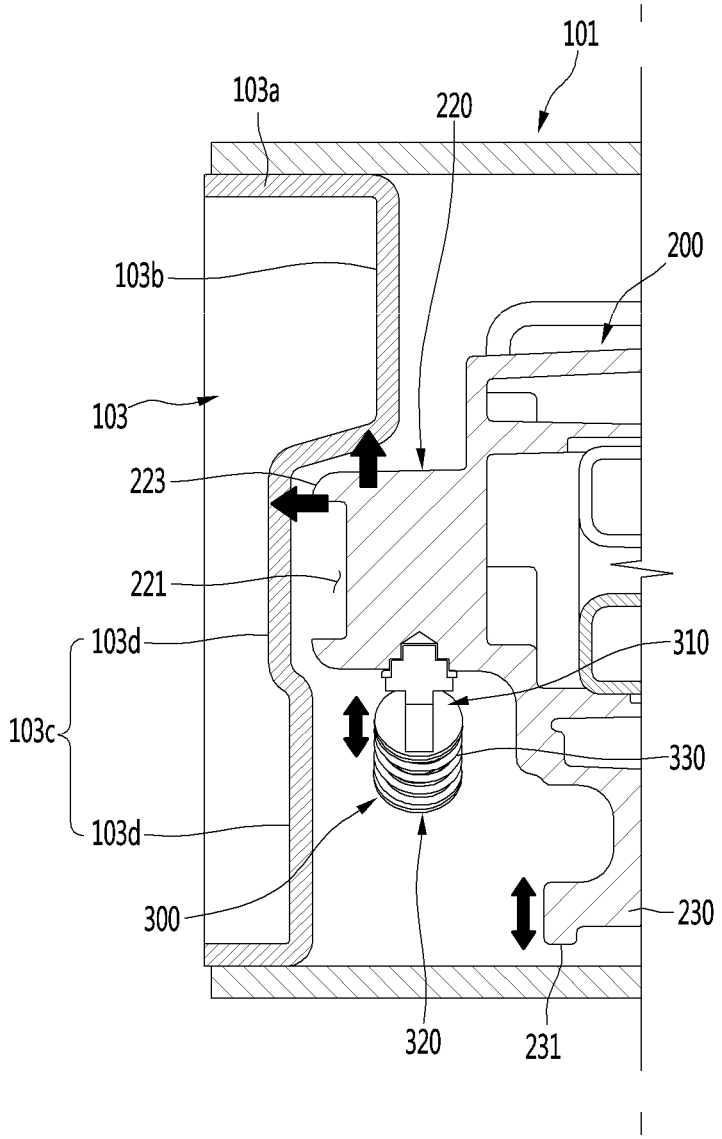
FIG. 16 is a cross-sectional view illustrating an example state of the compressor body supported at one end of the linear compressor.

FIG. 15 is a view illustrating an example state of transmission of vibration of the compressor body. FIG. 16 is a cross-sectional view illustrating an example state of the compressor body supported at one end of the linear compressor.

As illustrated in the drawings, in the state in which the linear compressor 10 is assembled, the front end of the compressor body, i.e., the support part of the discharge cover 200 may be supported downward by the second supporting damper 300.

In some implementations, in the state in which the second shell cover 103 is closed, the center accommodation part 103*d* of the second shell cover 103 may be adjacent to the front end of the support part 220 to prevent the compressor body from being separated from the normal operation position by excessive forward movement. In some implementations, the recess part 103*b* of the second shell cover 103 may be provided above the support part 220. The recess part 103*b* may further extend backward than the support part 220 to restrict the upward movement of the support part 220.

In some implementations, the side stopper 230 may protrude from the lower end of the discharge cover 200. When the compressor body excessively moves downward, the side stopper 230 and the shell 101 may come into contact with each other to prevent the impact from being applied to the compressor body.

That is, even though the large impact is applied during the transportation or operation of the linear compressor 10, the compressor body may be prevented from being separated from the normal position by the second shell cover 103 and the side stopper 230.

In some implementations, the load of the compressor body and the vibration occurring during the operation of the linear compressor 10 may be transmitted to the shell 101 by the second supporting damper 300. Here, the second supporting damper 300 may come into one point contact with the support part 220. Thus, the vibration transmitted to the second supporting damper 300 through the support part 220 may be uniformly dispersed to both sides through the first leg part 311 and the second leg part 312. In some implementations, the vibration transmitted through the supporting leg 310 may be attenuated by the elastic member 330 and then be transmitted to the shell 101, which comes into two point contact with the supporting leg 310, by the contact member 320.

Since the end of the supporting leg 310 and the contact member 320 are spaced apart from each other, even though force is transmitted from the supporting leg 310 in various manners by the movement of the compressor body, the contact member 320 may maintain the vertical contact with the shell 101 to attenuate the impact and the vibration. In some implementations, the contact member 320 and the supporting leg 310 may be spaced apart from each other. Thus, the linear compressor may be more freely movable to effectively reduce the irregular vibration or impact by the adequate movement of the supporting leg 310.

In some implementations, the first supporting damper 185 may also have the same structure as the second supporting damper 300.

However, in the state in which the front opening of the shell 101 is disposed to face the upper side, the linear compressor 10 may have a structure in which the compressor body to which the first supporting damper 185 is coupled is inserted through the front opening of the shell 101 and then assembled. In this structure, when the first supporting damper 185 has the same structure as the second supporting damper 300, the assembly of the first supporting damper 185 may be difficult somewhat within the shell 101.

Thus, for convenience of the assembly, the first supporting damper 185 having the plate spring structure may be mounted first on the rear surface of the inserted compressor body, and in the state in which the compressor body is inserted into the shell 101, the second supporting damper 300 may be mounted, and then, the second shell cover 103 may be closed.

In some implementations, the first supporting damper 185 having the plate spring structure may be provided on one end of the compressor body to stably fix the compressor body. In some implementations, the second supporting damper 300 that performs the more effective buffering operation may be disposed on the other end of the compressor body, on which the discharge cover 200 is disposed, to maintain the stably mounted state of the compressor body and reduce the vibration and the impact at the same time.

The linear compressor according to the implementations may have the following effects.

According to the implementation, both the ends of the compressor body may be respectively supported by the first supporting damper and the second supporting damper to prevent the compressor from being separated during the transportation and operation of the compressor, thereby continuously operating in the stable state.

Particularly, the first supporting damper including the spring structure having the plate shape may connect the shell cover to the compressor body to more firmly and stably fix the one end of the compressor body, and the second supporting damper may have the structure that connects the compressor body to the shell to more effectively buffer the vibration of the compressor body.

In some implementations, the second supporting damper may come into one point contact with the support part and come into two point contact with the inner surface of the shell to uniformly transmit the vibration of the compressor body to the shell, thereby minimizing the vibration and the noise.

In some implementations, the second supporting damper may have the structure that supports the support part at the lower side of the support part. Thus, the load of the support part, which is applied in the gravity direction, may be effectively dispersed and supported.

In some implementations, the end of the second supporting damper may come into contact with the inner surface of the shell at the position adjacent to the mounted position of the leg for fixing and mounting the shell. Thus, the vibration noise of the shell may be minimized in spite of the vibration transmitted to the shell.

In some implementations, the elastic member having the spring shape may be provided on the second supporting damper, and the end of the second supporting damper may come into crossing contact with the inner surface of the shell to more effectively buffer the vibration or the impact transmitted to the shell.

In some implementations, the second supporting damper may include the contact member coming into contact with the shell and the supporting leg coming into contact with the support part with respect to the elastic member. In some implementations, the end of the supporting leg and the end of the contact member may be maintained to be spaced apart from each other. Thus, even though the load is applied in various directions, the contact member may be maintained to come into vertical contact with the inner surface of the shell, thereby effectively attenuating the impact and the vibration.

In some implementations, the second supporting damper may be constituted by the supporting leg that is branched to both left and right sides, the pair of elastic members, and the contact member to reduce the impact and the vibration through the relatively small number and the simple structure. Thus, the assembling workability and the productivity may be significantly improved, and the manufacturing cost may be remarkably reduced.

In some implementations, the number of components of the second supporting damper may be reduced to simplify the assembly process. Thus, the possibility of defects during the assembly may be significantly reduced, and the quality performance may be improved due to the improvement of the durability.

In some implementations, the recess part that supports the support part upward to restrict the support part may be provided in the shell cover covering the opening of the shell so that the upward movement of the compressor body may be restricted. In some implementations, the center accommodation part in which the support part is accommodated may be provided in the shell cover to restrict and limit the forward movement of the support part by the center accommodation part.

Thus, even though the impact or the large vibration occurs during the transportation and operation of the linear compressor, the compressor body may be prevented from being separated from the normal position within the shell due to the restriction by the shell cover.

In some implementations, the extension accommodation part extending from the center accommodation part to the outer end of the discharge cover and accommodating the second supporting damper may be provided to also maintain the mounted position of the second supporting damper.

In some implementations, the first mounting groove and the second mounting groove that is further recessed from the center of the first mounting groove may be provided in the support part, and the second supporting damper may include the first and second protrusions, which are respectively inserted into the first and second mounting grooves, to prevent the misassembly from occurring and firmly maintain the assembly.

In some implementations, the side stopper may be provided to protrude from the outer end of the discharge cover, and the other component of the compressor body may be prevented from being damaged due to the direct contact with the inner surface of the shell by the side protrusion.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a shell that defines an outer appearance of the linear compressor and that extends along a longitudinal direction of the shell, the shell having a first opening and a second opening that are defined at opposite ends of the shell;

a first shell cover that covers the first opening of the shell;

a second shell cover that covers the second opening of the shell;

a compressor body accommodated in the shell, the compressor body comprising a cylinder and a piston disposed in the cylinder and configured to move in the longitudinal direction to thereby compress refrigerant within the cylinder;

a support part that protrudes from an end portion of the compressor body toward the second opening of the shell; and a supporting damper that extends from the support part toward an inner surface of the shell, wherein the supporting damper comprises:

a first supporting damper that connects an end of the compressor body to the first shell cover, and a second supporting damper that connects the support part to an inner surface of the shell and is coupled to the support part, the second supporting damper comprising a first leg part and a second leg part that are arranged symmetrical to each other with respect to a center portion of the second supporting damper, wherein the center portion of the second supporting damper is disposed at a central line of the shell, is coupled to the support part, and contacts the support part at one point, and wherein an end of the first leg part contacts a first point at the inner surface of the shell, and an end of the second leg part contacts a second point at the inner surface of the shell, the first and second points being spaced apart from each other along the inner surface of the shell.

2. The linear compressor according to claim 1, wherein each of the first supporting damper and the second supporting damper is configured to attenuate vibration of the compressor body.

3. The linear compressor according to claim 1, wherein the first leg part and the second leg part are spaced apart from each other by a set angle.

4. The linear compressor according to claim 3, wherein the set angle is in a range from 90° to 120°.

5. The linear compressor according to claim 1, further comprising a mounting leg disposed at an outer surface of the shell and configured to fix and mount the shell to a base, wherein the second supporting damper extends from the support part toward a position of the inner surface of the shell corresponding to a position of the outer surface of the shell at which the mounting leg is disposed.

6. The linear compressor according to claim 1, wherein the second shell cover comprises:

a recess part that is recessed from an outer surface of the second shell cover toward an inside of the shell and that overlaps an upper portion of the support part in the longitudinal direction, the recess part being configured to restrict an upward movement of the support part; and an accommodation part that is stepped from the recess part, that protrudes outward of the recess part toward the outer surface of the second shell cover, and that accommodates the second supporting damper.

7. The linear compressor according to claim 6, wherein the accommodation part comprises:

a center accommodation part that extends radially outward from a center of the second shell cover, that faces an outer circumferential surface of the support part, and that accommodates at least a portion of the support part; and an extension accommodation part that extends from a side of the center accommodation part to a circumferential surface of the second shell cover and that accommodates the second supporting damper.

8. The linear compressor according to claim 1, wherein the support part comprises:

a support part end surface that faces the second shell cover; and a support part groove recessed inward from the support part end surface toward the compression body.

9. The linear compressor according to claim 1, wherein the support part defines a damper mounting part recessed from a circumferential surface of the support part, and wherein the second supporting damper further comprises a coupling protrusion inserted into the damper mounting part to thereby fix the second supporting damper to the support part.

10. The linear compressor according to claim 9, further comprising a seating member that is made of an elastic material, and that is disposed between the damper mounting part and the coupling protrusion, the seating member having a shape corresponding to the coupling protrusion.

11. The linear compressor according to claim 9, wherein the damper mounting part comprises:

a first mounting groove recessed from the circumferential surface of the support part to a first position; and a second mounting groove recessed from the first mounting groove to a second position radially inward of the first position, and wherein the coupling protrusion comprises a first protrusion configured to be inserted into the first mounting groove, and a second protrusion that protrudes from the first protrusion and that is configured to be inserted into the second mounting groove.

12. The linear compressor according to claim 11, wherein the damper mounting part defines an opening having a polygonal shape, and wherein the damper coupling part has a shape corresponding to the polygonal shape.

13. The linear compressor according to claim 1, wherein the second supporting damper is a single body having a V-shape, and wherein the first leg part and the second leg part are parts of the single body.

14. The linear compressor according to claim 1, wherein the second supporting damper further comprises:

a first contact member that is disposed at the end of the first leg part and contacts the inner surface of the shell;

a second contact member that is disposed at the end of the second leg part and contacts the inner surface of the shell;

a first elastic member that connects between the end of the first leg part and an inner end of the first contact member; and a second elastic member that connects between the end of the second leg part and an inner end of the second contact member.

15. The linear compressor according to claim 1, wherein the first supporting damper comprises:

an elastic plate having a plate spring shape;

a plurality of coupling members disposed at an edge region of the elastic plate and coupled to the compressor body; and a plate fixing member disposed at a center of the elastic plate and supported by the first shell cover.

16. The linear compressor according to claim 1, wherein the ends of the first and second leg parts are lower ends of the first and second leg parts, respectively, the lower ends facing the inner surface of the shell, and wherein upper ends of the first and second leg parts are connected to each other and disposed vertically above the lower ends, the upper ends facing the support part.

17. The linear compressor according to claim 16, wherein the second supporting damper further comprises a coupling protrusion disposed between the upper ends of the first and second leg parts and inserted into the support part.

18. A linear compressor comprising:

a shell;

a compression body disposed in the shell, the compression body comprising a cylinder disposed in the shell, a piston disposed in the cylinder and configured to compress refrigerant in the cylinder, and a motor assembly configured to drive the piston to move relative to the cylinder;

a discharge cover that is disposed at a side of the cylinder and that defines a cover space configured to receive refrigerant that is compressed by the piston and discharged from the cylinder;

a support part that protrudes from an end portion of the discharge cover; and a supporting damper that connects the support part to an inner surface of the shell and that is configured to attenuate vibration of the compression body, wherein the supporting damper comprises:

a supporting leg comprising a first portion coupled to the support part and at least two second portions that extend toward the inner surface of the shell in directions symmetrical to each other with respect to the support part, a contact member disposed at an end of each of the at least two second portions and configured to contact the inner surface of the shell, and an elastic member that connects the end of each of the at least two second portions and an inner end of the contact member that faces the corresponding second portion of the supporting leg.

19. The linear compressor according to claim 18, wherein the support part and the discharge cover are portions of a single body.

20. The linear compressor according to claim 18, wherein the elastic member is made of a spring material, and is configured to maintain a gap defined between the supporting leg and the contact member.

21. The linear compressor according to claim 18, further comprising a mounting leg disposed at an outer surface of the shell and configured to fix and mount the shell to a base, wherein the supporting damper is disposed between the mounting leg and the support part.

22. The linear compressor according to claim 18, wherein the support part has a cylindrical shape, and wherein the first portion of the supporting leg comprises a seating part that has a curved shape corresponding to a circumferential surface of the support part and that supports the circumferential surface of the support part.

23. The linear compressor according to claim 18, further comprising a side stopper that protrudes from an outer surface of the discharge cover toward the shell, the side stopper being configured to limit movement of components within the shell in a direction toward the inner surface of the shell, wherein the side stopper is disposed at a position between the at least two second portions of the supporting leg.

24. The linear compressor according to claim 23, wherein the side stopper is disposed at an extension line that extends from the support part toward a center of the supporting damper.

* * * * *